US007530828B2

(12) United States Patent
Miyazono

(10) Patent No.: US 7,530,828 B2
(45) **Date of Patent: *May 12, 2009**

(54) ELECTRICAL CONNECTOR AND LIQUID CRYSTAL DISPLAY DEVICE

(75) Inventor: Katsunori Miyazono, Osaka (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 366 days.

This patent is subject to a terminal disclaimer.

(21) Appl. No.: 11/511,336

(22) Filed: Aug. 29, 2006

(65) Prior Publication Data

US 2007/0064169 A1 Mar. 22, 2007

(30) Foreign Application Priority Data

Aug. 29, 2005 (JP) ..... 2005-248118

(51) Int. Cl.
*H01R 33/02* (2006.01)

(52) U.S. Cl. ..... 439/232; 439/242; 362/226

(58) Field of Classification Search ..... 439/232, 439/242, 239; 362/226, 225
See application file for complete search history.

(56) References Cited

U.S. PATENT DOCUMENTS 3,851,295 A * 11/1974 Geier ..... 439/232
4,795,357 A * 1/1989 Kosmol et al. ..... 439/232
5,743,626 A * 4/1998 Walker ..... 362/217
5,886,158 A * 3/1999 Meyer et al. ..... 534/16
6,869,300 B2 * 3/2005 Lefki et al. ..... 439/242
7,159,996 B2 * 1/2007 Huang et al. ..... 362/225
7,265,500 B2 * 9/2007 Ono et al. ..... 362/225
7,344,397 B2 * 3/2008 Miyazono ..... 439/232
7,347,705 B1 * 3/2008 Huang et al. ..... 439/231
7,399,190 B2 * 7/2008 Ohmori ..... 439/226

FOREIGN PATENT DOCUMENTS

JP 2001-250605 A 9/2001
JP 2004-259645 A 9/2004

* cited by examiner

*Primary Examiner*—Briggitte R Hammond
(74) *Attorney, Agent, or Firm*—Rader, Fishman & Grauer, PLLC

(57) ABSTRACT

An electrical connector has a contact held by a housing and an operating member for operating the contact. The housing includes an insertion recess into which a shaft-like terminal is inserted in a first direction. A pair of elastic pieces of the contact respectively includes clamp portions for clamping the terminal in predetermined clamping directions orthogonal to the first direction. The first direction is in a radial direction of the terminal. The operating member includes widening operating portions for widening the distance between the clamp portions of the pair of elastic pieces.

15 Claims, 15 Drawing Sheets

15
D1
D2
38
39
40
41
30
31
32
33
37
26
28
28a
28b
29
X
Y
Z

ELECTRICAL CONNECTOR AND LIQUID CRYSTAL DISPLAY DEVICE

BACKGROUND OF THE INVENTION

1. Field of the Invention

The present invention relates to an electrical connector which is connected to a fluorescent tube, etc., and a liquid crystal display device including the same.

2. Description of Related Arts

For example, as a connecting structure of a terminal of a fluorescent tube such as a cold cathode fluorescent tube to be used as a backlight of a liquid crystal display type television or a monitor, the following documents 1 and 2 have been proposed:

Document 1: Japanese Unexamined Patent Publication No. 2001-250605 (date of publication: Sep. 14, 2001)

Document 2: Japanese Unexamined Patent Publication No. 2004-259645 (date of publication: Sep. 16, 2004)

In the documents 1 and 2, a connection fitting fixed to one end of an electric wire is soldered to a terminal (electrode) of a cold cathode fluorescent tube. The other end of the electric wire is connected to an inverter circuit via a connector. Electric power from the inverter circuit is supplied to the cold cathode fluorescent tube via the connector and the electric wire.

However, in the documents 1 and 2, a continuity failure may occur between the terminal and the connection fitting due to defective soldering. In addition, the soldering is troublesome. In particular, the cold cathode fluorescent tube has a thin shape with a diameter of several millimeters, and the terminal is thinner than this, so that handling of these requires great care. Therefore, enormous labor is required for soldering.

Not only the case of using a cold cathode fluorescent tube but also cases of using other fluorescent tubes such as an external electrode fluorescent tube or using a shaft-like terminal other than the fluorescent tubes also have a similar problem.

An object of the present invention is to provide an electrical connector that realizes reliable and easy connection of a shaft-like terminal and a liquid crystal display device including the same.

SUMMARY OF THE INVENTION

According to a preferred mode of the present invention, an electrical connector includes an insulating housing, a contact held by the housing, and an operating member for operating the contact. The housing includes an insertion recess into which a shaft-like terminal is inserted in a first direction. The contact includes a pair of elastic pieces facing each other. At least a portion of the pair of elastic pieces is exposed to the insertion recess. Each elastic piece is in a cantilevered shape having a base end portion and a tip end portion. The pair of elastic pieces is inclined with respect to the first direction so as to make a distance between the tip end portions narrower than a distance between the base end portions. The pair of elastic pieces has clamp portions, respectively, for clamping the terminal in predetermined clamping directions orthogonal to the first direction. The first direction is in a radial direction of the terminal. The operating member includes a widening operating portion for widening a distance between the clamp portions of the pair of elastic pieces.

According to the mode, while the distance between the clamp portions of the pair of elastic pieces of the contact are widened by the widening operating portion of the operating member, the terminal can be readily inserted between the clamp portions in their diameter directions. Next, by releasing the widening operation by the widening operating portion, the terminal is elastically clamped between the clamp portions. Thereby, a predetermined contact pressure is generated between the contact and the terminal, and as a result, electrical connection between the contact and the terminal can be reliably performed.

DETAILED DESCRIPTION OF THE PREFERRED EMBODIMENT

A preferred embodiment of the present invention will be described with reference to the accompanying drawings.

Figure 1:
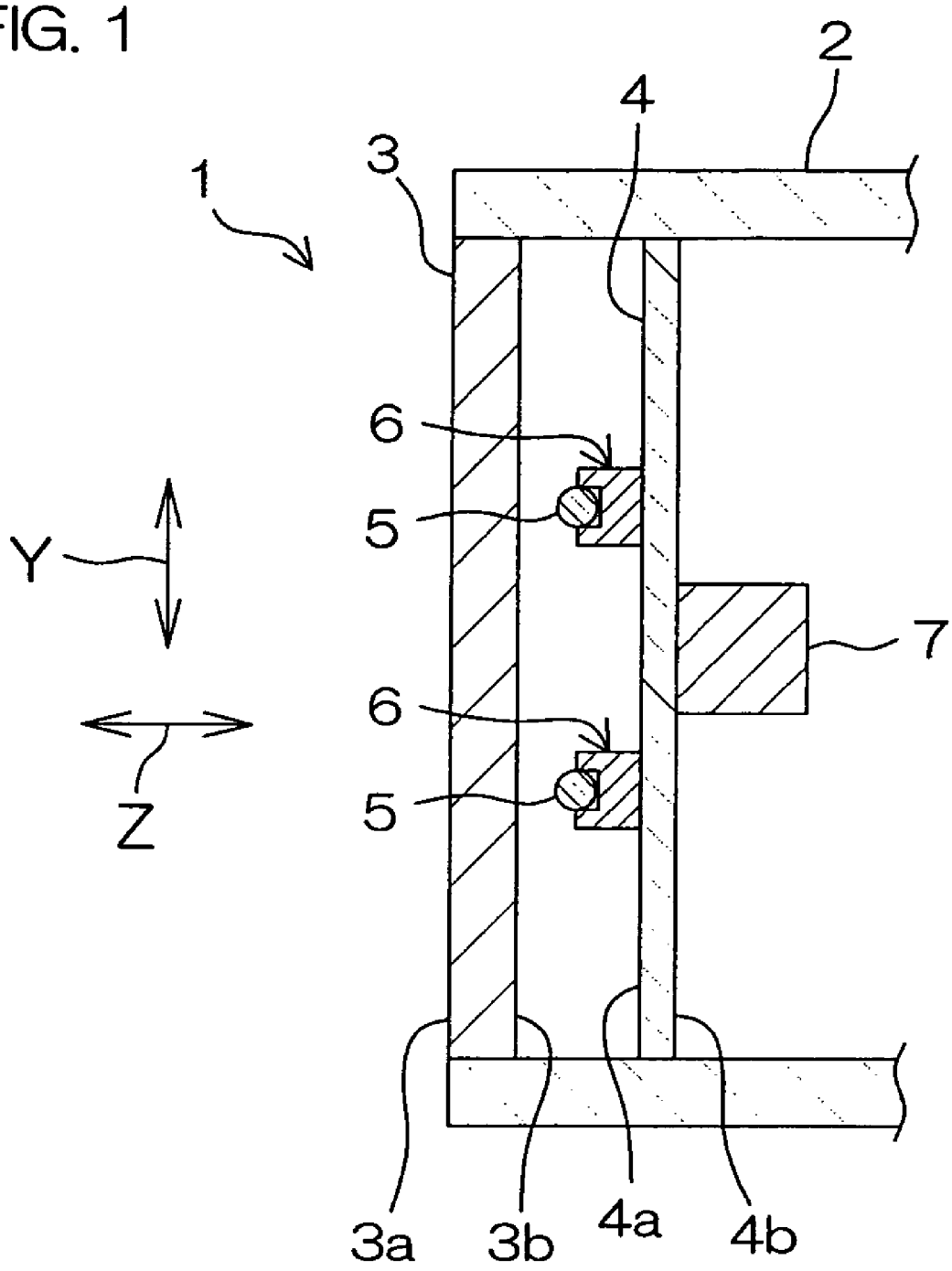
FIG. 1 is a schematic sectional view showing a general construction of a liquid crystal display device including an electrical connector according to an embodiment of the present invention.

FIG. 1 is a schematic sectional view showing a general construction of a liquid crystal display device including an electrical connector according to an embodiment of the present invention. Referring to FIG. 1, the liquid crystal display device 1 is used as, for example, a monitor of a television or a personal computer.

The liquid crystal display device 1 includes a casing 2, a liquid crystal panel 3, a circuit board 4, a plurality of cold cathode fluorescent tubes 5 as fluorescent tubes, electrical connectors 6 (hereinafter, can be simply referred to as connectors), and an inverter circuit 7.

The liquid crystal panel 3 is a non light-emitting display panel, and is attached to an opening on the front of the casing 2. The front face 3*a* of the liquid crystal panel 3 faces forward of the casing 2, and the back face 3*b* thereof faces rearward of the casing 2.

The circuit board 4 is a plate-shaped member disposed parallel to the liquid crystal panel 3 and fixed to the casing 2, and includes a first surface 4*a* facing the back face 3*b* of the liquid crystal panel 3 and a second surface 4*b* on the opposite side of the first surface 4*a*.

A plurality (two cold cathode fluorescent tubes 5 are shown in FIG. 1) of cold cathode fluorescent tubes 5 serve as a backlight of the liquid crystal panel 3, and are disposed between the back face 3*b* of the liquid crystal panel 3 and the first surface 4*a* of the circuit board 4. The number of cold cathode fluorescent tubes 5 is, for example, 2 per 1 inch of the liquid crystal panel 3.

Figure 2:
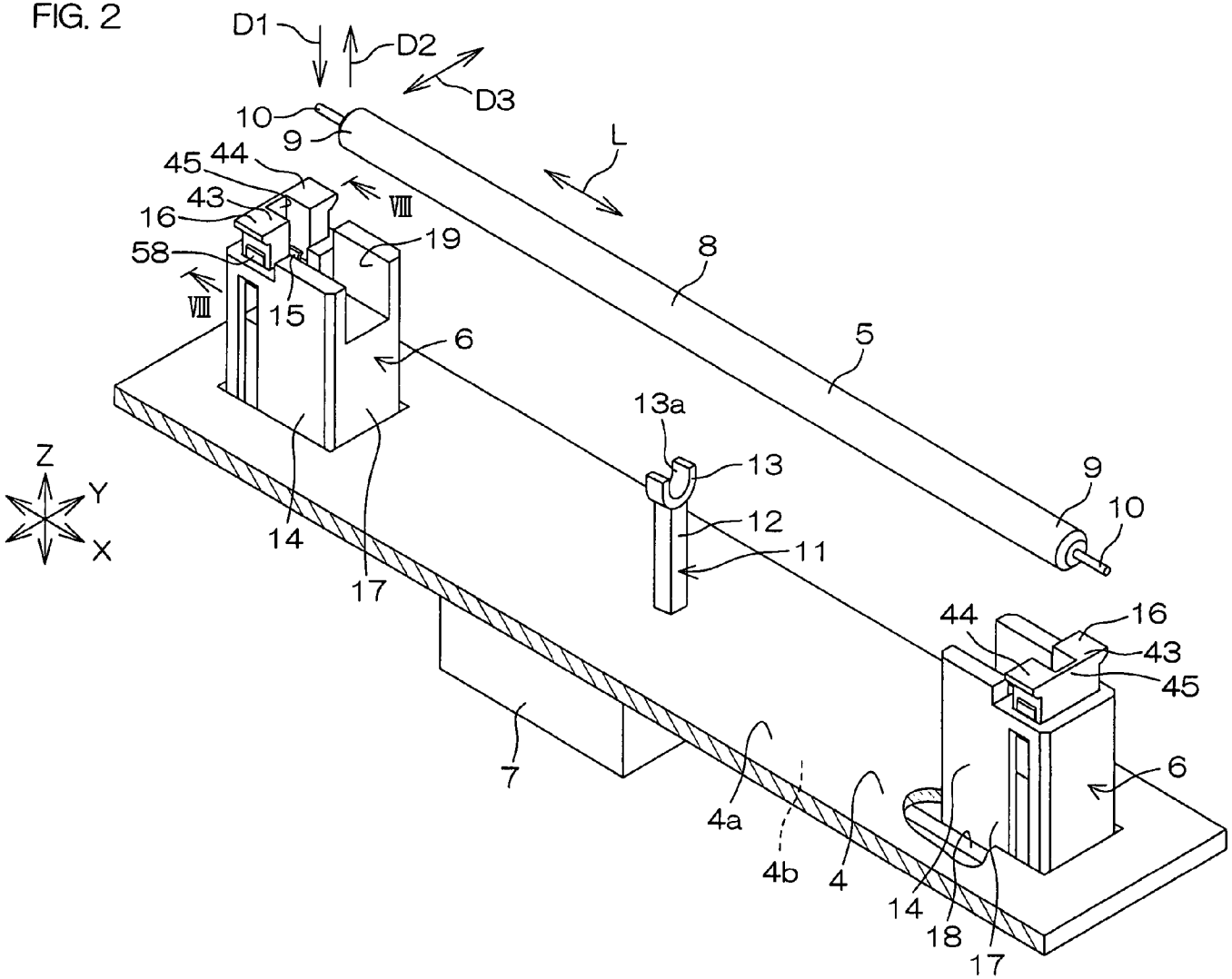
FIG. 2 is an exploded perspective view of a main part of the liquid crystal display device.

As shown in FIG. 2, the longitudinal direction L of each cold cathode fluorescent tube 5 is in the direction X (corresponding to the left and right direction of the casing 2: the direction perpendicular to the sheet surface in FIG. 1). Referring to FIG. 1, each cold cathode fluorescent tube 5 is disposed at predetermined intervals in the direction Y (corresponding to the vertical direction of the casing 2). Each cold cathode fluorescent tube 5 is parallel to the back face 3*b* of the liquid crystal panel 3. Each respective cold cathode fluorescent tube 5 and the liquid crystal panel 3 are spaced at a predetermined distance in the direction Z (corresponding to the lateral direction of the casing 2). Each cold cathode fluorescent tube 5 irradiates the liquid crystal panel 3 with light from the rear side.

The electrical connector 6 is for realizing electrical connection between the cold cathode fluorescent tubes 5 and the circuit board 4 (and eventually the inverter circuit 7). This connector 6 is attached to each pair of ends of the respective cold cathode fluorescent tube 5 between the back face 3*b* of the liquid crystal panel 3 and the first surface 4*a* of the circuit board 4. The respective connectors 6 are attached to the circuit board 4.

The inverter circuit 7 is for supplying driving power to the cold cathode fluorescent tubes 5, and is attached to the second surface 4*b* of the circuit board 4. The inverter circuit 7 and the respective cold cathode fluorescent tubes 5 are electrically connected to each other via the circuit board 4 and corresponding connectors 6.

The attaching structures of the respective cold cathode fluorescent tubes 5 are the same, so that the attaching structure of one cold cathode fluorescent tube 5 will be mainly described below.

Referring to FIG. 2, the cold cathode fluorescent tube 5 includes a cylindrical main body 8 extending straight in the direction X, and outer leads 10 and 10 (electrodes) as a pair of terminals provided on a pair of end portions 9 and 9 of the main body 8, respectively. The respective outer leads 10 as terminals project in the longitudinal direction L from the corresponding end portions 9 of the main body 8.

The main body 8 is a member made of, for example, glass with a diameter of several millimeters through several tens of millimeters. The pair of outer leads 10 and 10 are metal-made shaft-like conductive members made of soft iron, etc., and are exposed in the direction X from the respective corresponding end portions 9. These outer leads 10 have a diameter of, for example, approximately 1 millimeter and a length of several millimeters.

A clamping member 11 is provided for holding the cold cathode fluorescent tube 5 and supporting the weight of the cold cathode fluorescent tube 5. One or a plurality (one in this embodiment) of clamping members 11 are provided for each cold cathode fluorescent tube 5. The number of clamping members 11 is properly determined according to the length of the cold cathode fluorescent tube 5. The clamping member 11 is arranged at a middle portion of the main body 8 of the cold cathode fluorescent tube 5 with respect to the direction X.

This clamping member 11 is, for example, a synthetic resin molded item, and includes a support column 12 and an arced holder 13. The support column 12 is fixed to the first surface 4*a* of the circuit board 4 and extends in the direction Z. The holder 13 holds the middle portion of the main body 8 of the cold cathode fluorescent tube 5 while restraining radial (in the directions Y and Z in FIG. 2) movements of the cold cathode fluorescent tube 5.

This holder 13 is in an arced shape that can surround a portion slightly longer than a peripheral half of the main body 8 of the cold cathode fluorescent tube 5. In a portion in the peripheral direction of the holder 13, an opening 13*a* in which the main body 8 of the cold cathode fluorescent tube 5 is inserted is formed.

In the opening 13*a*, the middle portion in the longitudinal direction L of the main body 8 of the cold cathode fluorescent tube 5 is inserted and held in a first direction D1 as an attaching direction corresponding to the radial direction of the cold cathode fluorescent tube 5 to the connectors 6. The opening 13*a* is open to a second direction D2 (corresponding to a removing direction of the cold cathode fluorescent tube 5 from the connectors 6) opposite to the first direction D1.

The connector 6 is provided on the pair of end portions 9 and 9, respectively, of the main body 8 of the cold cathode fluorescent tube 5 as described above. The constructions of the respective connectors 6 are the same, so that one connector 6 will be mainly described below.

Figure 3:
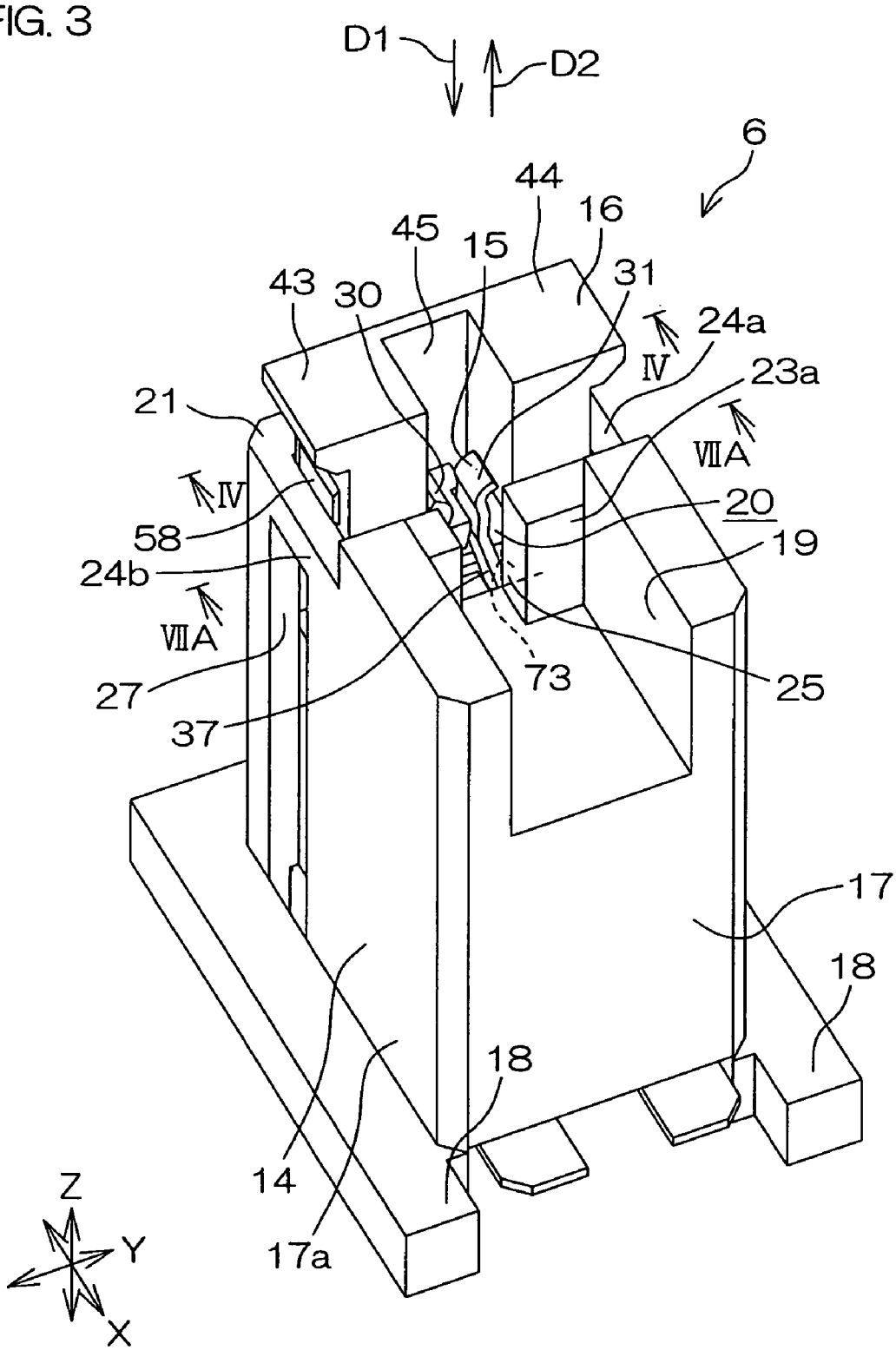
FIG. 3 is a perspective view of an electrical connector.

Referring to FIG. 2 and FIG. 3, the connector 6 has lengths of 10 through 15 millimeters in the directions X, Y and Z, respectively, and includes a housing 14, a contact 15 held by this housing 14, and an operating member 16; for operating this contact 15.

The housing 14 is an integrally molded item made of a synthetic resin, and has a main body 17 and seating portions 18 extended from the main body 17.

The main body 17 is generally shaped into a box. In the circuit board 4, a through hole is formed at the place where the connector 6 is disposed, and through this through hole, the main body 17 projects from the first surface 4*a* to the back face 3*b* (see FIG. 1) of the liquid crystal panel 3.

Referring to FIG. 2 and FIG. 3 again, at an end portion in the second direction D2 of the main body 17, an introducing groove 19 having a U-shaped or a groove-shaped section is formed. Into the introducing groove 19, a corresponding end portion 9 of the cold cathode fluorescent tube 5 can be introduced. The end portion 9 of the cold cathode fluorescent tube 5 introduced into the introducing groove 19 is protected by being surrounded by the inner surface of the introducing groove 19.

Figure 4:
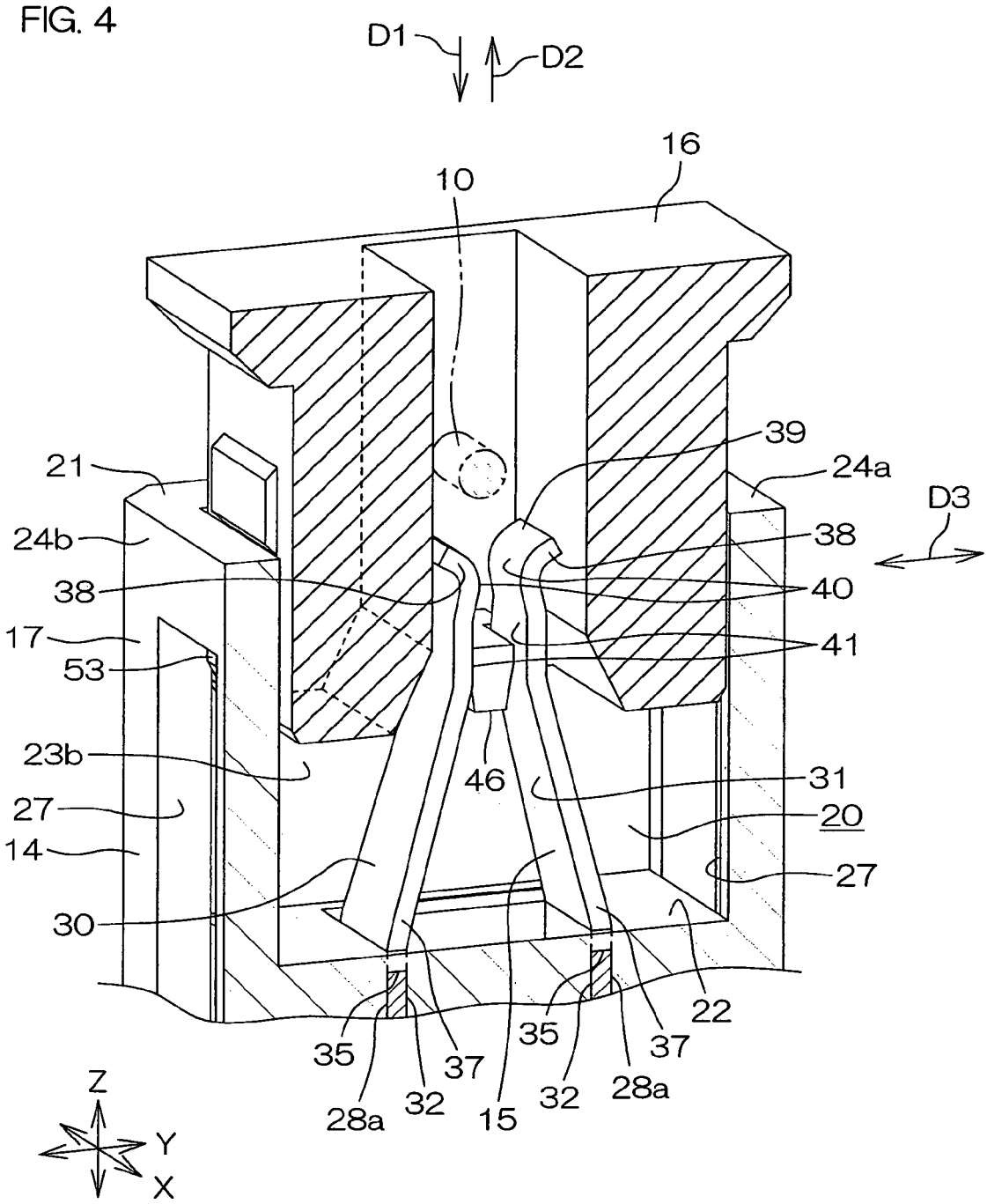
FIG. 4 is a sectional view of a main part in the IV-IV line of FIG. 3.

Referring to FIG. 3 ad FIG. 4, at the end portion in the second direction D2 of the main body 17, an insertion recess 20 is provided. Into the insertion recess 20, an outer lead 10 as a terminal of the cold cathode fluorescent tube 5 is inserted in the first direction D1 as the attaching direction.

The insertion recess 20 is demarcated by a peripheral wall 21 and a bottom wall 22 and has a rectangular section, and functions as a receiving cavity for receiving the outer lead 10. The peripheral wall 21 includes a pair of first side portions 23*a* and 23*b* facing each other in the direction X and a pair of second side portions 24*a* and 24*b* facing each other in the direction Y.

One first side portion 23*a* is adjacent to the introducing groove 19, and divides between the introducing groove 19 and the insertion recess 20. In the first side portion 23*a*, at the center in the direction Y, a notched groove 25 is provided. Into the notched groove 25, a corresponding outer lead 10 can be inserted.

In the second side portions 24*a* and 24*b*, through holes 27 are formed, respectively. The respective through holes 27 extend in the direction Z, and in the through holes, first and second convex portions 53 and 58 described later of the operating member 16 are inserted.

Figure 5:
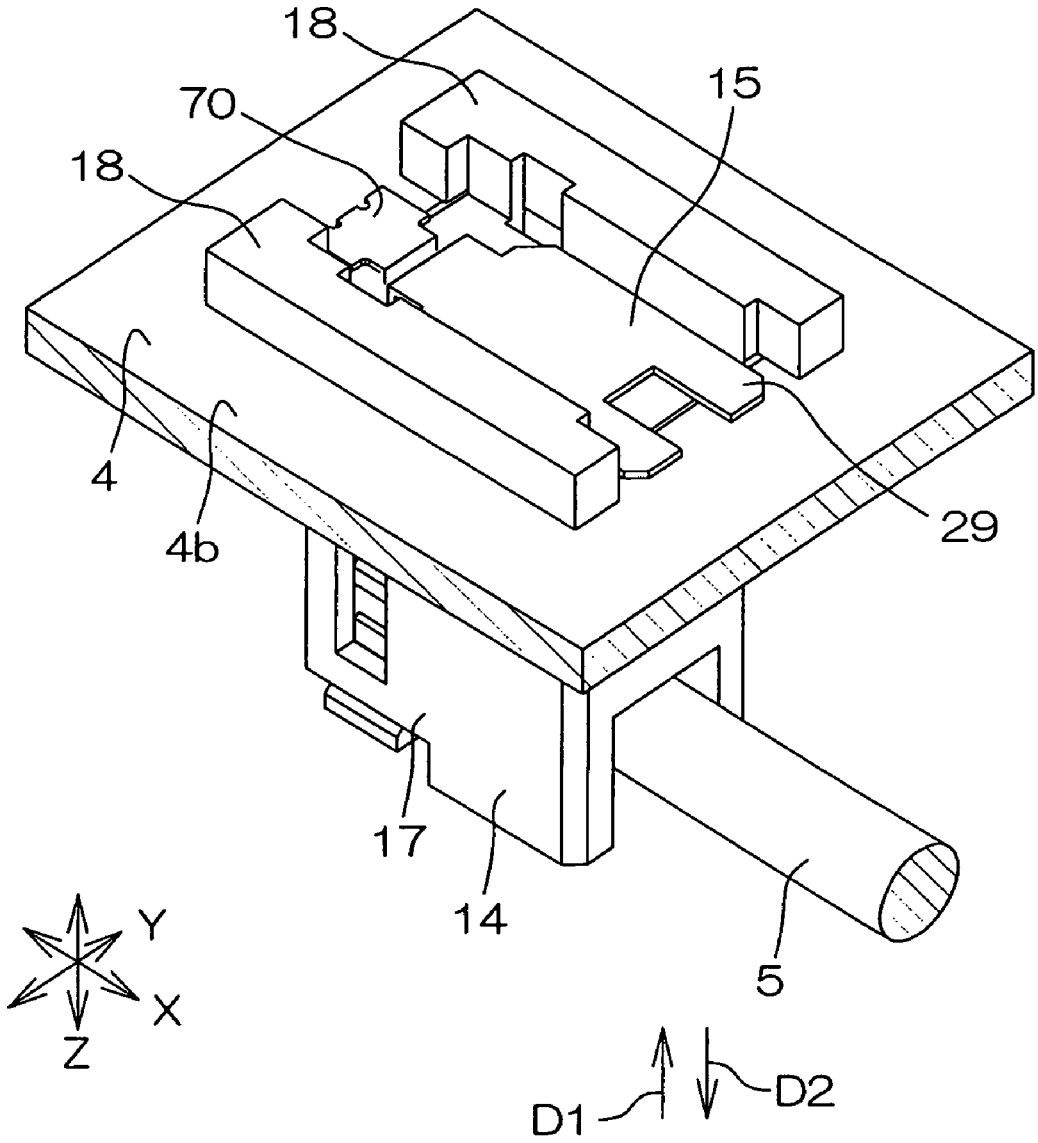
FIG. 5 is a partially broken perspective view of a main part of the liquid crystal display device, showing a state observed from a second surface side of a circuit board.

The seating portions 18 are a pair of flange portioins provided on the end portions 17*a* of the main body 17 in the first direction D1. The seating portions 18 are disposed on the pair of end portions in the direction Y of the main portion 17, respectively, and extend longitudinally in the direction X. Referring to FIG. 5, the respective seating portions 18 are in contact with and received by the second surface 4*b* of the circuit board 4. Thereby, the position of the housing 14 in the direction Z with respect to the circuit board 14 is determined. A metal-made reinforcement member 70 attached to the main body 17 of the housing 14 is fixed to the second surface 4*b* of the circuit board 4.

Figures 6A, 6B:
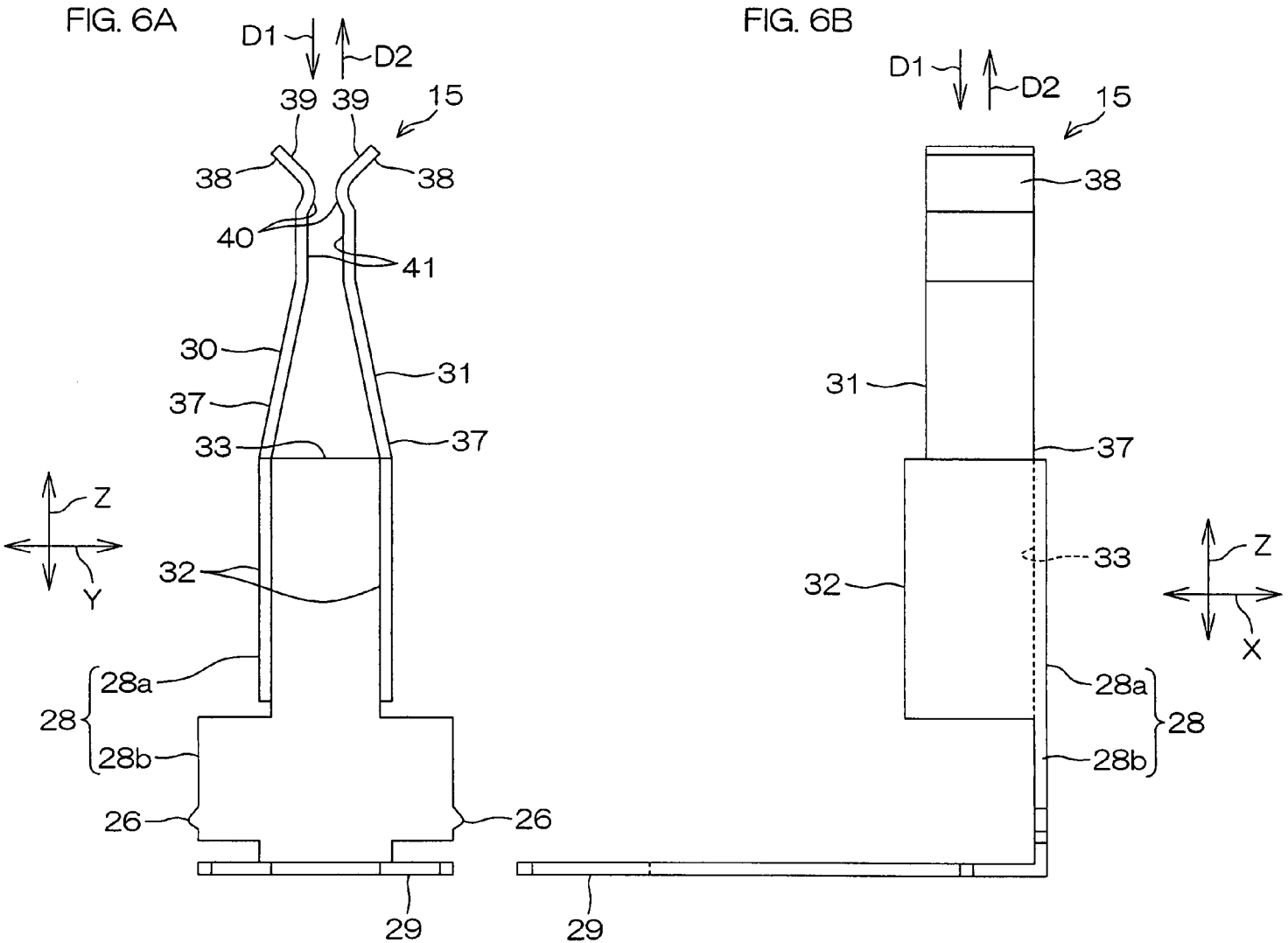
FIG. 6A is a front view of a contact.
FIG. 6B is a right side view of the contact of FIG. 6A.

Referring to FIG. 2, FIG. 6A, and FIG. 6B, the contact 15 is, for example, a conductive member made of a metal, etc. In detail, the contact 15 is a sheet metal member. The contact 15 is electrically connected to the outer lead 10 of the cold cathode fluorescent tube 5 attached in the first direction D1. By the contact 15, electrical connection between the outer lead 10 and the circuit board 4 is realized.

Referring to FIG. 6A, FIG. 6B, FIG. 7A, and FIG. 7B, the contact 15 is symmetrical to the direction Y, and has a main body 28, a lead 29, and a pair of elastic pieces 30 and 31 facing each other. The main body 28 extends longitudinally in the direction Z, and has a first portion 28*a* and a second portion 28*b*.

The first portion 28*a* has a U-shaped section orthogonal to the direction Z, and a pair of portions facing each other of the U shape is formed into flange portions 32. In the first portion 28*a*, the section sandwiched by the flange portions 32 is defined as an intermediate portion 33.

The second portion 28*b* extends to the second direction D2 side from the intermediate portion 33 of the first portion 28*a*, and is in a roughly rectangular shape relatively long in the direction Y and relatively short in the direction Z. The second portion 28*b* projects toward both sides of the direction Y with respect to the first portion 28*a*. Each of the pair of edges of the second portion 28*b* is provided with a projection 26 for press-fitting and engaging with the housing 14.

The main body 28 is press-fitted in and fixed to an insertion hole 34 formed in the main body 17 of the housing 14. The insertion hole 34 extends in the direction Z to the insertion recess 20 from the end portion 17*a* in the second direction D2 of the main body 17 of the housing 14. The peripheral surface of the insertion hole 34 surrounds the main body 28 of the contact 15.

On the peripheral surface of the insertion hole 34, a pair of engaging grooves 35 and 35 that engage with the pair of flange portions 32, respectively, are formed. The engaging grooves 35 extend in the direction Z, and in the engaging grooves 35, the first portion 28*a* of the main body 28 of the contact 15 can be inserted. The pair of engaging grooves 35 end before the insertion recess 20 so as to prevent the first portion 28*a* of the main body 28 from projecting to the insertion recess 20 as shown in FIG. 4.

Figure 7A:
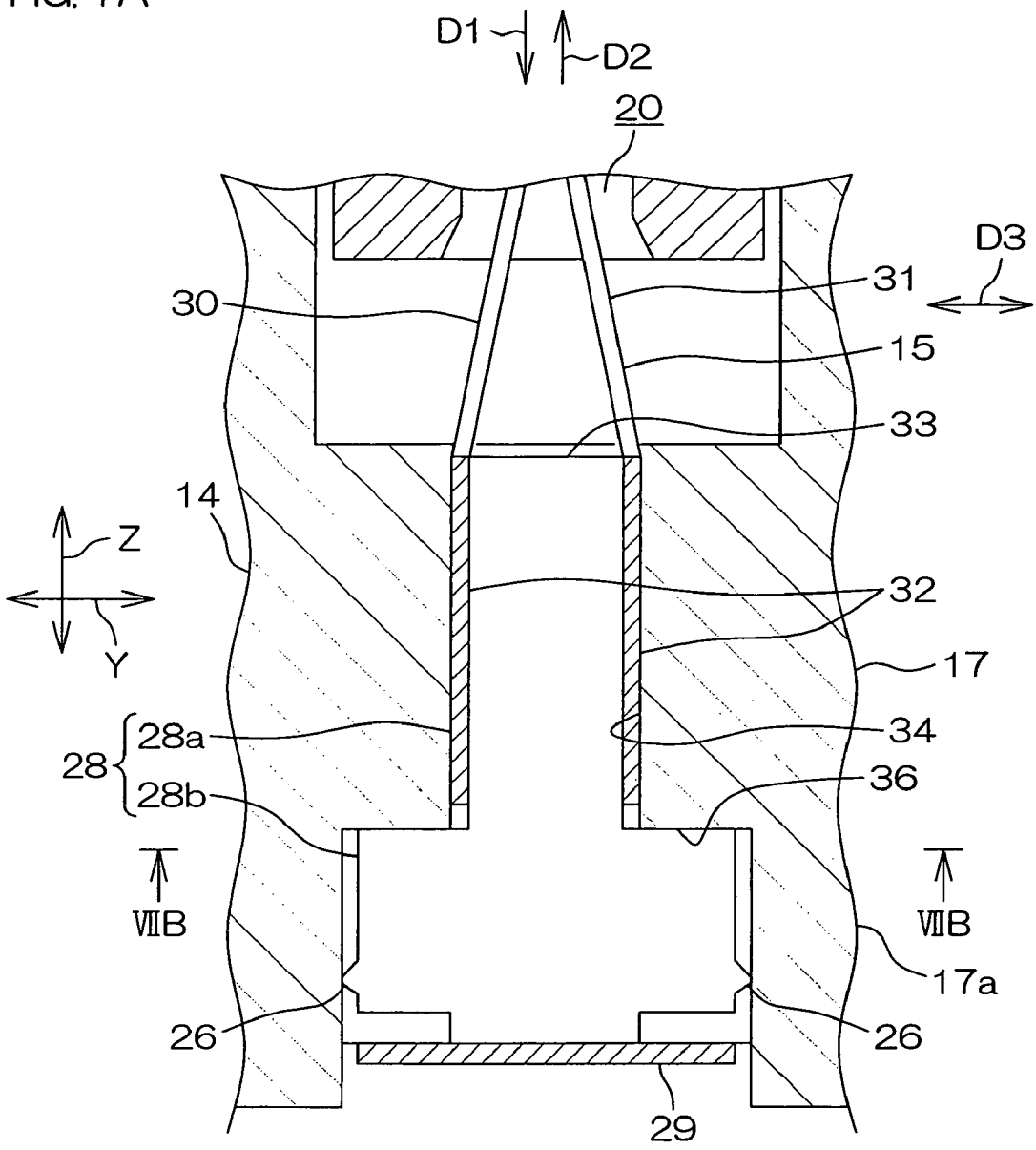
FIG. 7A is a sectional view in the VIIA-VIIA line of FIG. 3.
Figure 7B:
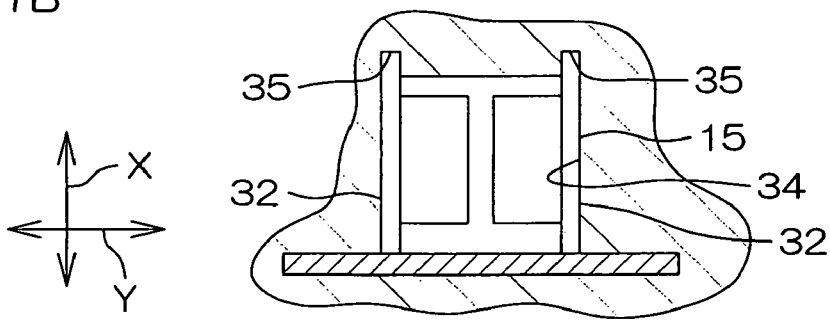
FIG. 7B is a sectional view of a main part in the VIIB-VIIB line of FIG. 7A.

Referring to FIG. 6A, FIG. 6B, FIG. 7A, and FIG. 7B again, the second portion 28*b* is inserted into the insertion hole 34, and the main body 28 is press-fitted and fixed to the housing 14 by pressure contact between the peripheral surface of the insertion hole 34 and the respective projections 26 of the second portion 28*b*. The second portion 28*b* is received by a stepped portion 36 of the insertion hole 34, and thereby, the contact 15 is positioned in the direction Z with respect to the housing 14.

Referring to FIG. 5, FIG. 6A, and FIG. 6B, the lead 29 comes into contact with the second surface 4*b* of the circuit board 4 and realizes electrical connection between the circuit board 4 and the contact 15. This lead 29 is provided on the tip end portion of the second portion 28*b* of the main body 28, extends to one side of the direction X, and is parallel to the second surface 4*b*. The lead 29 and the second surface 4*b* of the circuit board 4 are in contact with each other. The lead 29 is soldered to the circuit board 4 and connected to the inverter circuit via the circuit board 4.

Referring to FIG. 4 and FIG. 6A, a pair of elastic pieces 30 and 31 is electrically connected to a corresponding outer lead 10, respectively. The pair of elastic pieces 30 and 31 faces each other in the direction Y. The pair of elastic pieces 30 and 31 are disposed on the second direction D2 side with respect to the corresponding flange portions 32 and extend so as to project to the insertion recess 20, and almost the entirety thereof are exposed to the insertion recess 20.

It is also possible that only a part of the pair of elastic pieces 30 and 31 is exposed to the insertion recess 20. The pair of elastic pieces 30 and 31 bends and deform around their base end portions 37, and as a result, the tip end portions 38 and 38 of the pair of elastic pieces 30 and 31 can elastically come close to or apart from each other.

Each of the pair of elastic pieces 30 and 31 is in a cantilevered shape having the base end portion 37 and the tip end portion 38. In a free state (a state without an external force applied), when the respective pair of elastic pieces 30 and 31 are observed in the direction X, the elastic pieces 30 and 31 are inclined with respect to the first direction D1. As a result, the distance between the tip end portions 38 of the pair of elastic pieces 30 and 31 becomes narrower than the distance between the base end portions 37.

Each of the elastic pieces 30 and 31 includes a guide portion 39, a narrowing portion 40, and a straight clamp portion 41 for clamping the outer lead 10 in a predetermined clamping direction D3 (corresponding to the radial direction of the outer lead 10). The clamp portion 41 extends straight in the first direction D1.

The pair of guide portions 39 is provided on each side surface (inner side surfaces) of the corresponding tip end portions 38. The pair of guide portions 39 is for guiding the attaching of the outer lead 10, and is provided on the sides opposite the pair of clamp portions 41 with respect to the pair of narrowing portions 40. The pair of guide portions 39 is formed into smoothly curved shapes, and narrows their distance toward the first direction D1.

The pair of narrowing portions 40 is for preventing the corresponding outer lead 10 from improperly coming off in the second direction D2 from the pair of clamp portions 41. The pair of narrowing portions 40 are provided on the first direction D1 side with respect to the pair of guide portions 39, and provided on the sides (second direction D2 sides) opposite the first direction D1 with respect to the pair of clamp portions 41.

The distance between the pair of narrowing portions 40 is made narrower than the distance between the pair of guide portions 39, and made narrower than the distance between the pair of clamp portions 41. When the pair of elastic pieces 30 and 31 is elastically made close to each other, the distance between the pair of narrowing portions 40 becomes narrower than the diameter of the outer lead 10.

The pair of clamp portions 41 are for allowing relative movements of the corresponding outer lead 10 in the first and second directions D1 and D2 (direction Z) while realizing electrical connection between the corresponding outer lead 10 and the contact 15. The respective clamp portions 41 are provided on the tip end portions 38 of corresponding elastic pieces 30 and 31, and positioned on the first direction D1 sides of the corresponding narrowing portions 40. The respective clamp portions 41 extend in the direction Z (first direction D1 side) in a free state, and face parallel to each other.

Figure 9:
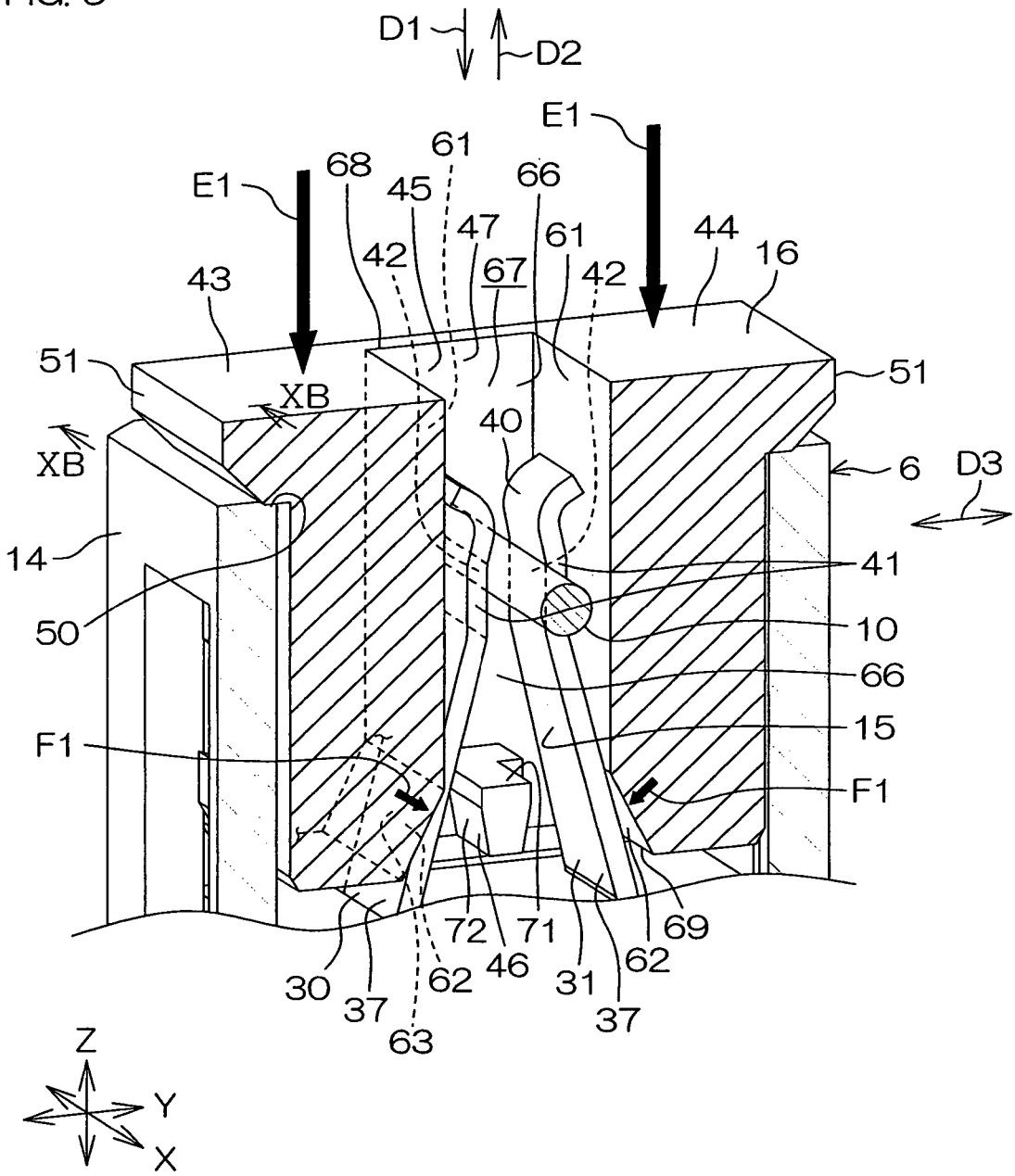
FIG. 9 is a sectional view in the VIII-VIII line of FIG. 2, showing a state that widening of the contact is released.

Referring to FIG. 9, in each clamp portion 41, a portion in contact with the outer lead 10 forms a contact portion 42. The pair of contact portions 42 faces each other in the direction Y, and elastically clamps the outer lead 10 there between in the radial direction. The contact portions 42 are disposed between the back face 3*b* of the liquid crystal panel 3 and the first surface 4*a* (see FIG. 1) of the circuit board 4.

Figure 8:
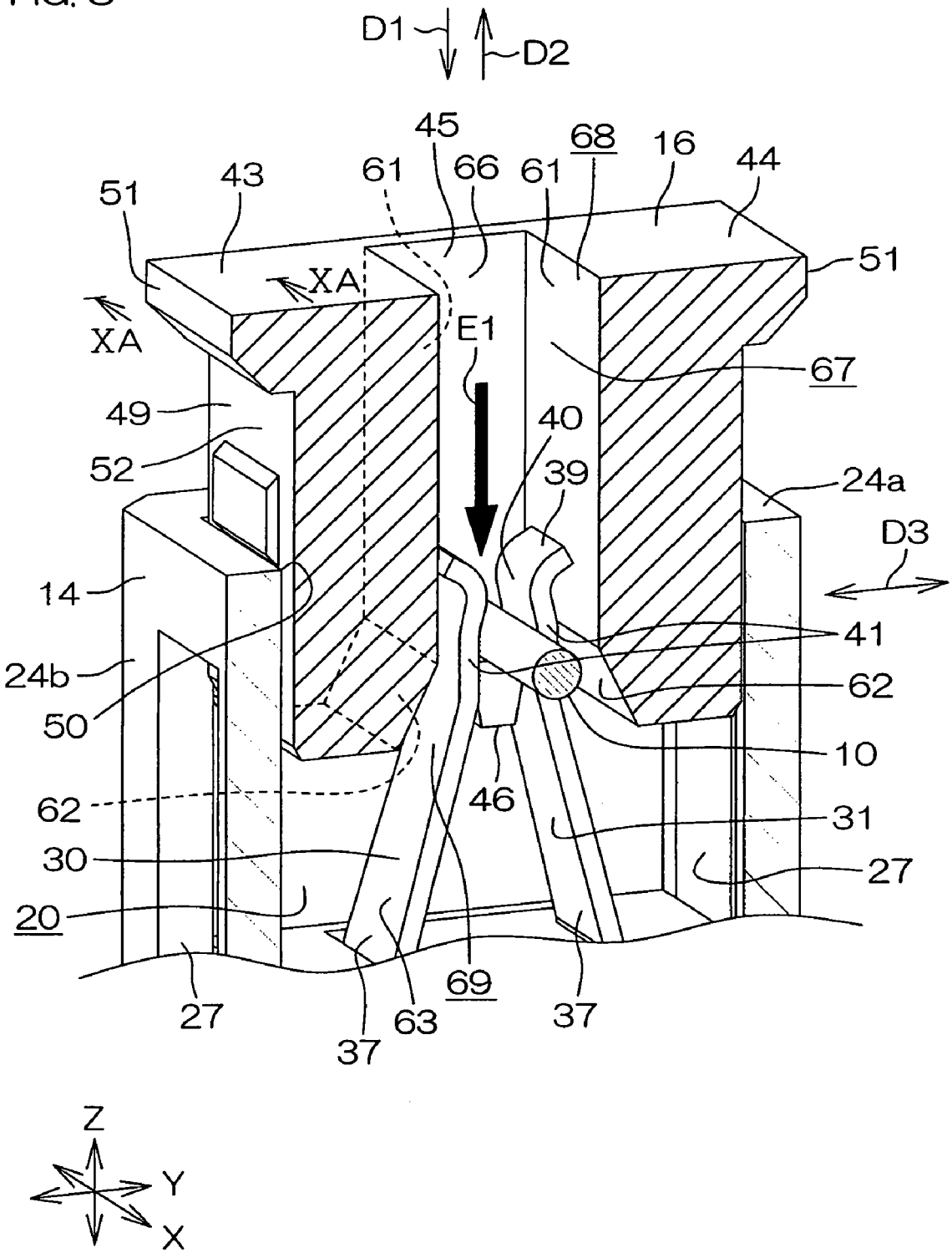
FIG. 8 is a sectional view in the VIII-VIII line of FIG. 2, showing a state that the contact is widened.

Referring to FIG. 8, the operating member 16 is for performing operations of clamping and releasing the clamping of the outer lead 10 by the pair of clamp portions 41. The operating member 16 is fitted in the insertion recess 20 of the housing 14 relatively movably in the first and second directions D1 and D2. In FIG. 8, the operating member 16 at a widening position is illustrated, and in FIG. 9, the operating member 16 at a widening released position is illustrated. The attaching of the operating member 16 to the housing 14 may be before or after the housing 14 is mounted on the circuit board.

Referring to FIG. 2 and FIG. 8, the operating member 16; is a resin molded item symmetrically formed to the direction Y, and its section orthogonal to the Direction Z is in a groove shape. The operating member 16 has a pair of portions 43 and 44 facing each other at a distance in the direction Y, a joint 45 that joins the pair of portions 43 and 44, and a widening operating portion 46 provided on the joint 45.

The pair of portions 43 and 44 is disposed on both sides across the pair of elastic pieces 30 and 31 in the insertion recess 20. One portion 43 is disposed between one elastic piece 30 and the other second side portion 24*b* of the peripheral wall 21. The other portion 44 is disposed between the other elastic piece 31 and the second side portion 24*a* of the peripheral wall 21. The pair of portions 43 and 44 extends longitudinally in the direction Z, respectively.

The tip ends on the second direction D2 sides of outer side surfaces 49 of the pair of portions 43 and 44 (only one outer side surface 49 is shown in FIG. 8) project outward of the direction Y with respect to a peripheral edge 50 of the opening of the insertion recess 20, and these projecting portions serve as knobs 51. An operator can operate the operating member 16 in the first and second directions D1 and D2 by pinching the knobs 51.

Figure 10A:
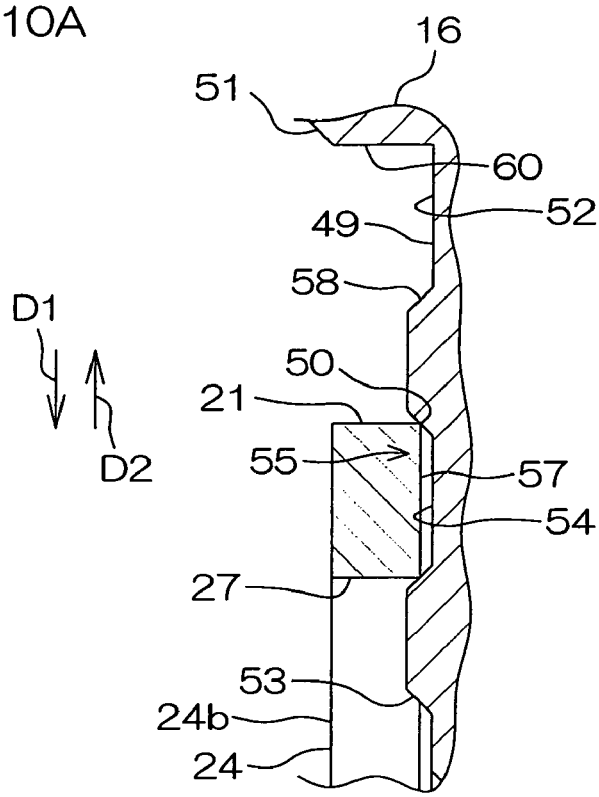
FIG. 10A is a sectional view in the XA-XA line of FIG. 8.

Referring to FIG. 8 and FIG. 10A, in the pair of outer side surfaces 49 (only one outer side surface 49 is shown in FIG. 10A), portions where the knobs 51 are not provided are formed into straight portions 52 extending in the direction Z. On the respective straight portions 52, first convex portions 53 are provided. The pair of first convex portions 53 are for preventing the operating member 16 from improperly coming off the insertion recess 20, and are disposed on the tip ends in the first direction D1 of the respective straight portions 52.

The respective first convex portions 53 are fitted in corresponding through holes 27 of the peripheral wall 21, and they are received by the peripheral edges of the corresponding through holes 27 to prevent the operating member 16 from coming off from the insertion recess 20.

The tip ends on the first direction D1 side of the first convex portions 53 are formed into inclined shapes. Thereby, when the operating member 16 is fitted in the insertion recess 20, these inclined portions smoothly engage with the peripheral edge 50 of the opening of the peripheral wall 21.

Figure 10B:
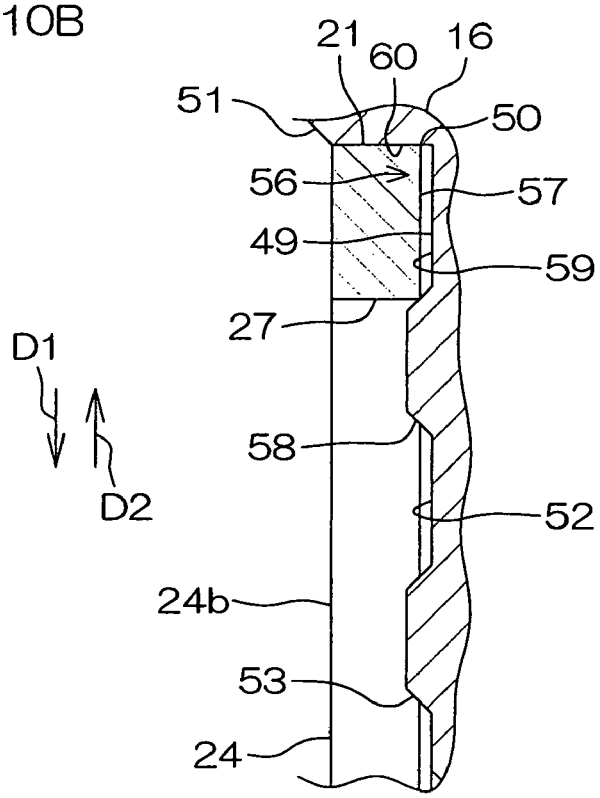
FIG. 10B is a sectional view in the XB-XB line of FIG. 9.

Referring to FIG. 10A and FIG. 10B, the connector 6 is provided with first and second holding mechanisms 55 and 56.

Referring to FIG. 10A, the first holding mechanism 55 holds the operating member 16 at the widening position. The first holding mechanism 55 includes first concave portions 54 provided on the respective straight portions 52 of the operating member 16, and engaging portions 57 that are provided on the pair of second side portions 24 of the peripheral wall 21, respectively, and engage with corresponding first concave portions 54.

The first concave portion 54 is demarcated between the first convex portion 53 and the second convex portion 58. The second convex portions 58 are provided on the respective straight portions 52 and arranged side by side with corresponding first convex portions 53 in the second direction D2. The engaging portions 57 include the portions disposed on the second direction D2 side of the through holes 27 on the pair of second side portions 24 of the peripheral wall 21, respectively, and are fitted in the first concave portions 54 when the operating member 16 is at the widening position.

Referring to FIG. 10B, the second holding mechanism 56 holds the operating member 16 at the widening released position. The second holding mechanism 56 includes second concave portions 59 provided on the respective straight portions 52 of the operating member 16 and the engaging portions 57 that are provided on the pair of second side portions 24 of the peripheral wall 21, respectively, and engage with corresponding second concave portions 59. That is, the engaging portions 57 form a part of the first holding mechanism 55 and a part of the second holding mechanism 56.

The second concave portions 59 are demarcated between the second convex portions 58 and stepped portions 60 of the respective knobs 51 facing the peripheral wall 21 side. The engaging portions 57 are fitted in the second concave portions 59 when the operating member 16 is at the widening released position.

Referring to FIG. 8, the inner side surfaces 61 of the pair of portions 43 and 44 face each other at a predetermined distance in the direction Y and sandwich the pair of elastic pieces 30 and 31 of the contact 15. The tip ends in the first direction D1 of these inner side surfaces 61 of the pair of portions 43 and 44 are formed into inclined cam surfaces, and the distance therebetween widens toward the first direction D1.

By the inclined cam surfaces, pressurizing portions 62 are formed. The pair of pressurizing portions 62 can pressurize pressurized portions 63 (only one pressurized portion 63 is shown in FIG. 8) provided on the one-side ends (outer side surfaces) of corresponding base end portions 37 of the pair of elastic pieces 30 and 31.

When the operating member 16 is at the widening released position shown in FIG. 9, the pair of pressurizing portions 62 come into contact with and pressurize the corresponding pressurized portions 63, thereby the distance between the pair of clamp portions 41 is narrowed, and as a result, the force for clamping the outer lead 10 by these clamp portions 41 can be increased. In addition, lowering in the clamping force due to settling of the pair of elastic pieces 30 and 31 can be prevented.

The pair of pressurizing portions 62 come into contact with and pressurizes corresponding pressurized portions 63 when the operating member 16 shifts from the widening position shown in FIG. 8 to the widening released position shown in FIG. 9 in the first direction D1. Thereby, the forces for pressurizing the corresponding pressurized portions 63 in the first direction D1 are converted into forces in the direction Y orthogonal to the first direction D1. Thereby, the pair of elastic pieces 30 and 31 comes close to each other.

The joint 45 is formed into a plate shape, and joins one-side ends in the direction X of the pair of portions 43 and 44.

Referring to FIG. 8, in the operating member 16, an external form of a section of a portion where the knob 51 is not provided cut in a direction orthogonal to the direction Z is substantially made coincident with the shape of the peripheral edge 50 of the opening of the insertion recess 20 observed from the first direction D1. Thereby, the insertion recess 20 is used as a guide groove for guiding the operating member 16 to the widening position and the widening released position in the first and second directions D1 and D2.

By the inner side surface 66 of the joint 45 and the inner side surfaces 61 of the pair of portions 43 and 44, a space 67 in which the pair of elastic pieces 30 and 31 can be accommodated (space between the pair of portions 43 and 44) is demarcated.

The tip end in the first direction D1 and the tip end in the second direction D2 of this space 67 are respectively opened to the outside, and these open portions are made into a pair of open portions 68 and 69. By the open portion 68, the space 67 is opened to the second direction D2, and thereby, the space 67 can be observed from the outside. Through the open portion 68, a corresponding outer lead 10 can be inserted into the space 67.

Referring to FIG. 8 and FIG. 9, the widening operating portion 46 is for widening the distance between the clamp portions 41 by engaging with the corresponding clamp portions 41 of the pair of elastic members 30 and 31, and is made of small pieces projectedly provided on the inner side surface 66 of the joint 45. The widening operating portion 46 is sandwiched between the pair of pressurizing portions 62 in the direction Y, and is inserted between the pair of elastic pieces 30 and 31 of the contact 15.

When the operating member 16 is at the widening position, the widening operating portion 46 is in contact with the pair of clamp portions 41, respectively, and thereby, the distance between the pair of clamp portions 41 and the pair of narrowing portions 40 is made larger than the outer diameter of the outer lead 10.

One-side surface of the widening operating portion 46 turned toward the second direction D2 faces a corresponding outer lead 10 in the direction Z, and is used as a receiving portion 71 for receiving the outer lead 10. When the operating member 16 is at a widening position, the receiving portion 71 can receive the corresponding outer lead 10 at positions corresponding to the pair of clamp portions 41.

The widening operating portion 46 includes a pair of side surfaces (only one side surface is shown in FIG. 9) facing each other in the direction Y, and the side surfaces include inclined cam surfaces 72 inclined with respect to the first direction D1, respectively.

The pair of inclined cam surfaces 72 performs a function to widen the distance between the pair of narrowing portions 40 when the operating member 16 is fitted in the insertion recess 20 in the first direction D1. The distance between the pair of inclined cam surfaces 72 narrows toward the first direction D1. When the operating member 16 is fitted inside the insertion recess 20 in the first direction D1, the pair of inclined cam surfaces 72 smoothly engages with the pair of narrowing portions 40, thereby the distance between the pair of narrowing portions 40 can be smoothly widened.

Referring to FIG. 3, one first side portion 23*a* of the peripheral wall 21 includes a restricting portion 73. The restricting portion 73 is for restricting the pair of elastic pieces 30 and 31 from shifting in the direction X (longitudinal direction L of the cold cathode fluorescent tube 5: direction in the axial direction of the outer lead 10). The restricting portion 73 is provided on one side surface (inner side surface facing the insertion recess 20) of the one first side portion 23*a* and faces the base end portions 37 of the respective elastic pieces 30 and 31. The restricting portion 73 restricts the elastic pieces 30 and 31 from moving to one side of the direction X (side on which the cold cathode fluorescent tube disposed).

Referring to FIG. 8 and FIG. 9, the widening position of the operating member 16 can be defined as a position for widening the distance between the pair of clamp portions 41 by the widening operating portion 46 so that the outer lead 10 can be inserted between the pair of clamp portions 41 with no insertion force. The widening released position can be defined as a position for releasing this widening.

Referring to FIG. 2 and FIG. 4, in the liquid crystal display device having the above-described general construction, the cold cathode fluorescent tube 5 (outer lead 10) is mounted as follows; first, the operating member 16 is held at the widening position. Thereby, the widening operating portion 46 of the operating member 16 engages with the respective clamp portions 41 of the pair of elastic members 30 and 31, and the distance between the pair of elastic pieces 30 and 31 is widened. At this time, the distance between the pair of clamp portions 41 is made wider than the diameter of the outer lead 10, and the distance between the pair of first narrowing portions 40 is made wider than the diameter of the outer lead 10.

In this state, the corresponding cold cathode fluorescent tube 5 is grasped by hand (not shown), and the outer lead 10 of the cold cathode fluorescent tube 5 is made to face the operating member 16 in the direction Z. Then, the cold cathode fluorescent tube 5 is moved toward the first direction D1 and the middle portion of the cold cathode fluorescent tube 5 is fitted in the holder 13 of the clamping member 11. Thereby, the middle portion of the cold cathode fluorescent tube 5 is held by the clamping member 11.

At this time, the corresponding outer lead 10 of the cold cathode fluorescent tube 5 is moved into the insertion recess 20 in the arrow E1 as shown in FIG. 8, passes between the pair of guide portions 39 and between the pair of narrowing portions 40 and disposed between the pair of clamp portions 41. The outer lead 10 disposed between the pair of clamp portions 41 is received by the receiving portion of the widening operating portion 46, and is positioned in the direction Z with respect to the pair of clamp portions 41.

Next, the operating member 16 is moved toward the first direction D1 and shifted from the widening position to the widening released position shown in FIG. 9. Thereby, the widening of the distance between the pair of clamp portions 41 by the widening operating portion 46 is released and the support of the corresponding outer lead 10 by the receiving portion 71 is released. As a result, due to the elastic restitution of the pair of elastic pieces 30 and 31, the corresponding outer lead 10 is clamped between contact portions 42 of the clamp portions 41 of the pair of elastic pieces 30 and 31. Thereby, electrical connection between the contact 15 and the corresponding outer lead 10 is achieved. The distance between the pair of narrowing portions 40 becomes narrower than the diameter of the corresponding outer lead 10.

In addition, by shifting the operating member 16 to the widening released position, the pair of pressurizing portions 62 pressurize the corresponding pressurized portions 63 as shown by the arrow F1 to move these pressurized portions 63 in the direction Y so as to come close to each other. Thereby, the distance between the base end portions 37 of the pair of elastic pieces 30 and 31 is narrowed, and as a result, pressurizing forces act on the pair of elastic pieces 30 and 31 so as to narrow the distance between the pair of clamp portions 41. Thereby, the force for clamping the corresponding outer lead 10 by the pair of clamp portions 41 is increased.

On the other hand, in order to remove the outer lead 10 from the contact 15, first, the operating member 16 is shifted from the widening released position to the widening position in the second direction D2 as shown in FIG. 8. Thereby, the pressurizing of the pair of pressurized portions 63 by the pair of pressurizing portions 62 is released.

When the operating member 16 is shifted to the widening position, the widening operating portion 46 enters between the pair of clamp portions 41, and thereby, the distance between the pair of clamp portions 41 is widened. As a result, electrical connection between the pair of clamp portions 41 and the corresponding outer lead 10 is released.

Next, as shown in FIG. 2 and FIG. 4, the cold cathode fluorescent tube 5 is removed from the holder 13 of the clamping member 11 by grasping the cold cathode fluorescent tube 5 by hand, etc., and moved toward the second direction D2. Thereby, the corresponding outer lead 10 of the cold cathode fluorescent tube 5 passes between the pair of narrowing portions 40 and between the pair of guide portions 39 from the point between the pair of clamp portions 41, and is then extracted from the insertion recess 20.

As described above, according to this embodiment, the pair of elastic pieces 30 and 31 comes into contact with a corresponding outer lead 10 with a predetermined contact pressure by elastically clamping the outer lead 10. Thereby, electrical connection between the contact 15 and the outer lead 10 can be reliably performed.

Furthermore, by widening the distance between the pair of clamp portions 41 by the widening operating portion 46, the outer lead 10 can be readily inserted between the clamp portions 41 with a little force, and as a result, electrical connection to the outer lead 10 can be readily performed. In addition, the pair of elastic pieces 30 and 31 can be formed into simple overturned-V shapes, so that the pair of elastic pieces 30 and 31 can be readily formed.

Furthermore, to connect the connectors 6 to the pair of respective outer leads 10 of the cold cathode fluorescent tube 5 and attach the connectors 6 to the circuit board 4, first, the pair of connectors 6 is singly attached to the circuit board 4. Thereafter, the pair of outer leads 10 of the cold cathode fluorescent tube 5 is inserted into the insertion recesses 20 of corresponding connectors 6 in the first direction D1 so that the pair of outer leads 10 is clamped between the corresponding pairs of clamp portions 41. That is, the connectors 6 are singly attached to the circuit board 4, and thereafter, the connectors 6 can be connected to the outer leads 10.

Therefore, conventional troublesome operations, that is, operations of manufacturing an assembly including connectors attached to each of the pair of outer leads, positioning the connectors of the assembly on the circuit board and attaching the connectors while maintaining the positioned state become unnecessary. Therefore, the operation of attaching the connectors 6 to the circuit board 4 can be readily performed.

The contact 15 and the corresponding outer lead 10 can be electrically connected by a simple operation of moving the operating member 16 toward the first direction D1 and shifting the same from the widening position to the widening released position, so that the electrical connecting operation between the contact 15 and the corresponding outer lead 10 can be automated by using machinery.

In addition, by widening the distance between the pair of clamp portions 41 by positioning the operating member 16 at the widening position, the corresponding outer lead 10 can be readily inserted between these clamp portions 41 with no insertion force. In addition, by releasing the widening by the widening operating portion 46 by shifting the operating member 16 to the widening released position after the outer lead 10 is inserted, the outer lead 10 can be reliably clamped by the elastic forces of the pair of elastic pieces 30 and 31, thereby the electrical connection to the outer lead 10 can be made more reliable.

In addition, the outer lead 10 that is very small in diameter and readily deformable can be readily inserted between the pair of clamp portions 41 with a little force, and as a result, an excessive force can be prevented from acting on the outer lead 10. The outer lead 10 can thus be prevented from being damaged.

Furthermore, the operating member 16 is held by the housing 14 in a manner enabling the operating member 16 to shift between the widening position and the widening released position, so that while holding the operating member 16 by the housing 14, the operating member 16 can be shifted to the widening position and the widening released position.

Furthermore, by providing the pair of pressurizing portions 62 on the operating member 16, the forces of the pair of clamp portions 41 to clip the outer lead 10 can be increased, and as a result, the contact between the clamp portions 41 and the outer lead 10 can be performed more reliably.

By providing the pressurizing portions 62 on the pair of portions 43 and 44 of the operating member 16, respectively, the pair of elastic pieces 30 and 31 can be clamped by the pair of pressurizing portions 62, and as a result, the pressurizing forces can be reliably supplied to these elastic pieces 30 and 31.

Furthermore, by forming an open portion 68 in the operating member 16, the space 67 between the pair of portions 43 and 44 can be visually observed through the open portion 68. Thereby, it can be readily confirmed whether the respective clamp portions 41 are in contact with the corresponding outer leads 10 and whether the pair of pressurizing portions 62 are pressurizing the pair of pressurized portions 63.

By using the insertion recess 20 as a guide groove, by a simple operation of moving the operating member 16 in the insertion recess 20, the operating member 16 can be reliably shifted between the widening position and the widening released position.

Furthermore, by placing the outer lead 10 on the receiving portion 71 of the widening operating portion 46 of the operating member 16 at the widening position, the outer lead 10 can be readily and reliably positioned with respect to the clamp portions 41.

By the first holding mechanism 55, the operating member 16 can be reliably held at the widening position.

Furthermore, by the second holding mechanism 56, the operating member 16 can be reliably held at the widening released position.

In addition, by disposing the cold cathode fluorescent tubes 5 on the first surface 4*a* of the circuit board 4 and disposing the inverter circuit 7 on the second surface 4*b* of the circuit board 4, these members can be stacked in the thickness direction of the circuit board 4. Thereby, the area occupied by the circuit board 4 in the plane direction can be reduced and space-saving thereof can be realized. By disposing the circuit board 4 between the cold cathode fluorescent tube 5 and the inverter circuit 7, the circuit board 4 can be used as an insulating layer between the cold cathode fluorescent tube 5 and the inverter circuit 7.

The present invention is not limited to the contents described in the embodiment given above.

Figure 11:
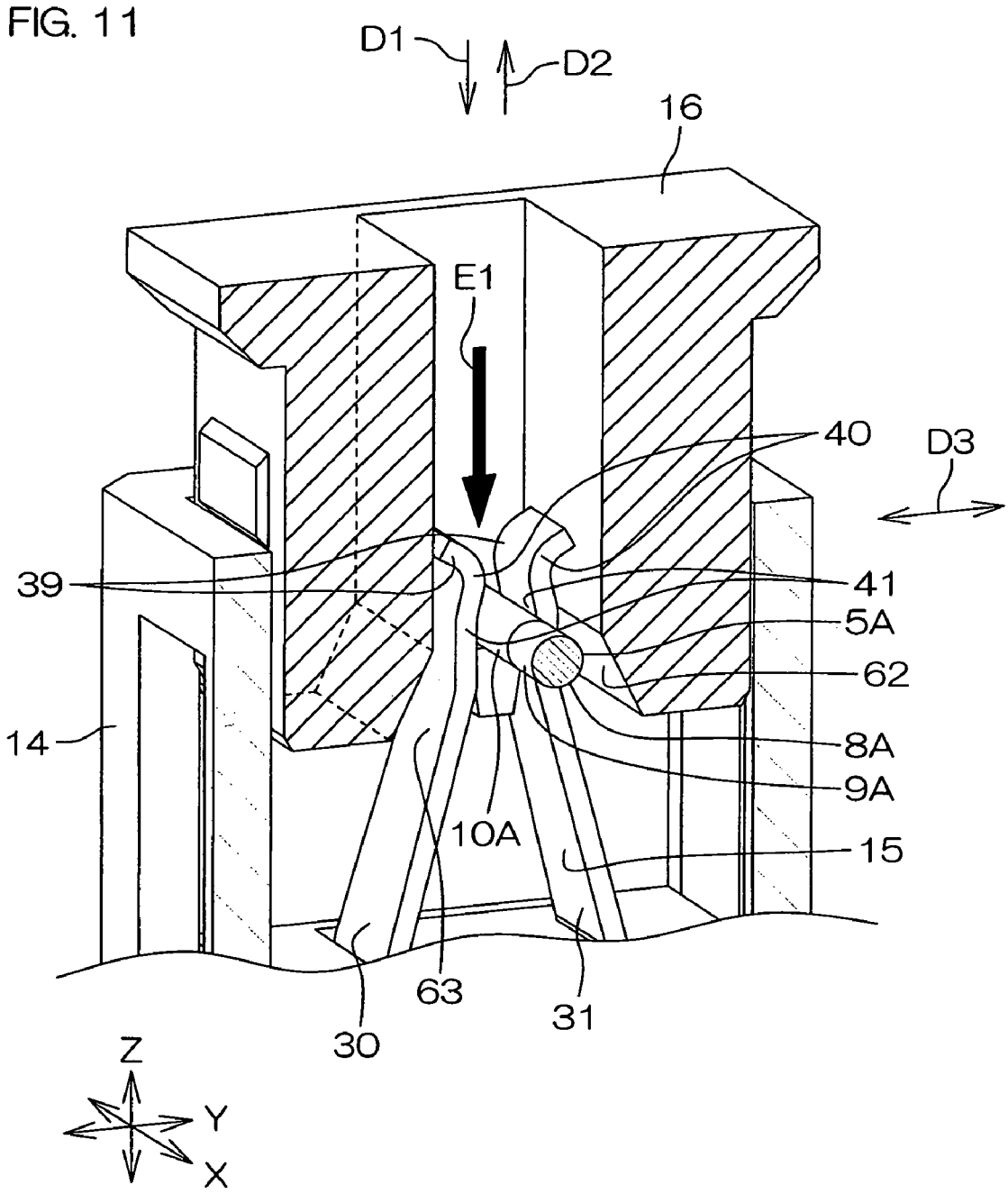
FIG. 11 is a partially broken perspective view of a main part of an electrical connector according to another embodiment of the present invention.

For example, an external electrode fluorescent tube 5A can be used instead of the cold cathode fluorescent tube 5 as shown in FIG. 11. In this case, an electrode layer 10A as a terminal is covered on the respective peripheral surfaces of a pair of end portions 9A (only one end portion 9A is shown in FIG. 11) of the main body 8A of the external electrode fluorescent tube 5A.

In this case, the electrode layer 10A can be readily inserted between the pair of clamp portions 41 with a little force, and an excessive force can be prevented from acting on the electrode layer 10A. The electrode layer 10A can be prevented from rubbing against and being damaged by the pair of elastic pieces 30 and 31.

The pair of pressurizing portions 62 and the corresponding pair of pressurized portions 63 can be omitted. Furthermore, the pair of guide portions 39 can be omitted, the pair of narrowing portions 40 can be omitted, and the receiving portion 71 of the widening operating portion 46 can be omitted.

Figure 12:
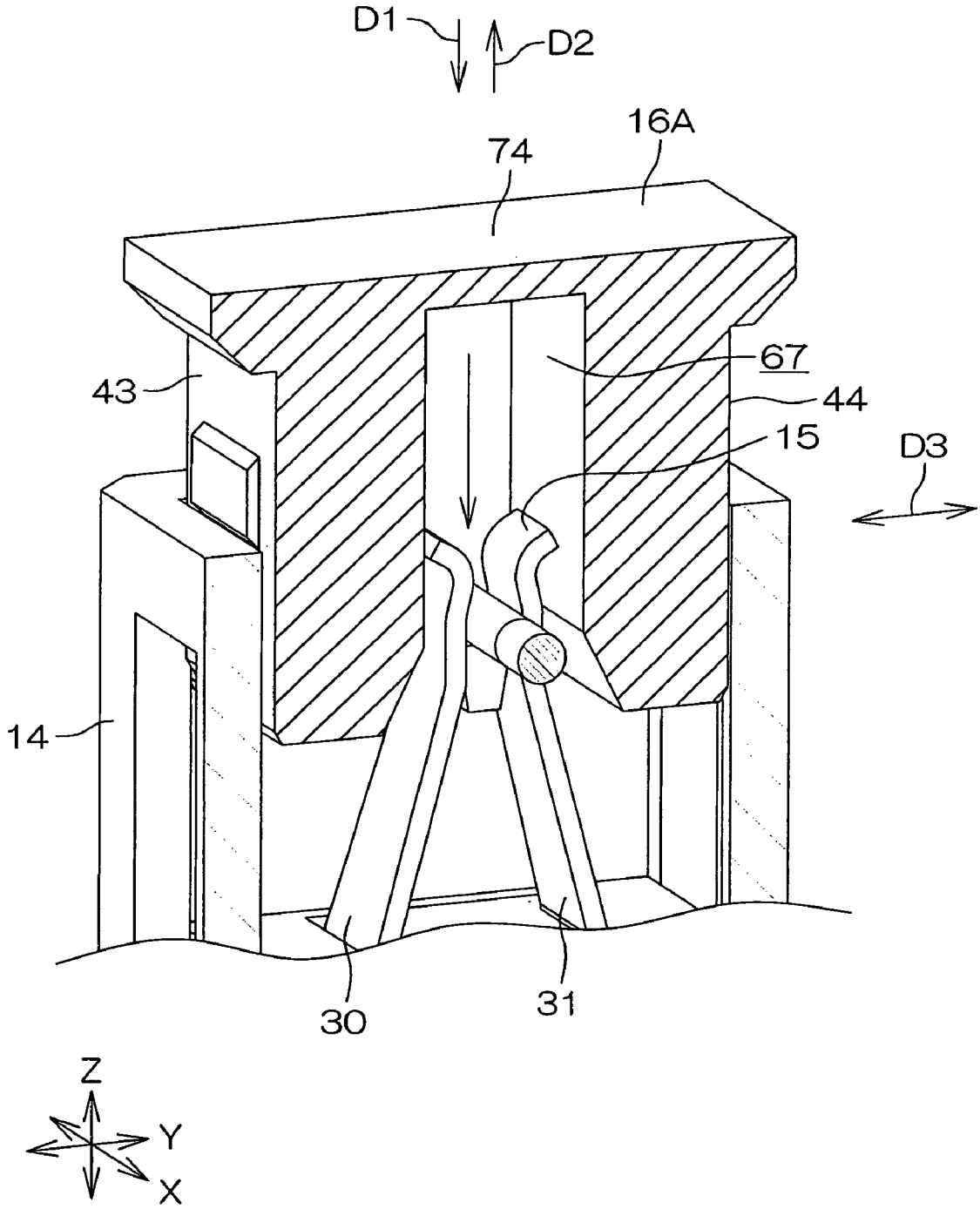
FIG. 12 is a partially broken perspective view of a main part of an electrical connector according to still another embodiment of the present invention.

In addition, instead of the operating member 16, the operating member 16A shown in FIG. 12 can be used. The operating member 16A has an opening preventive portion 74 that prevents the space 67 between the pair of portions 43 and 44 from opening to the second direction D2.

The opening preventive portion 74 is integrally formed with the pair of portions 43 and 44 by using a single member. This opening preventive portion 74 connects the tip end portions in the second direction D2 of the pair of portions 43 and 44 to each other, respectively. By providing the opening preventive portion 74, intrusion of foreign matter in the space 67 between the pair of portions 43 and 44 can be prevented.

By forming the section of the opening preventive portion 74 from a transparent material, the space 67 between the pair of portions 43 and 44 can be observed from the outside. It is also possible that the opening preventive portion 74 is separately formed from the pair of portions 43 and 44 and is joined thereto via a hinge mechanism. In this case, the space 67 between the pair of portions 43 and 44 can be observed by opening the opening preventive portion 74.

Figure 13:
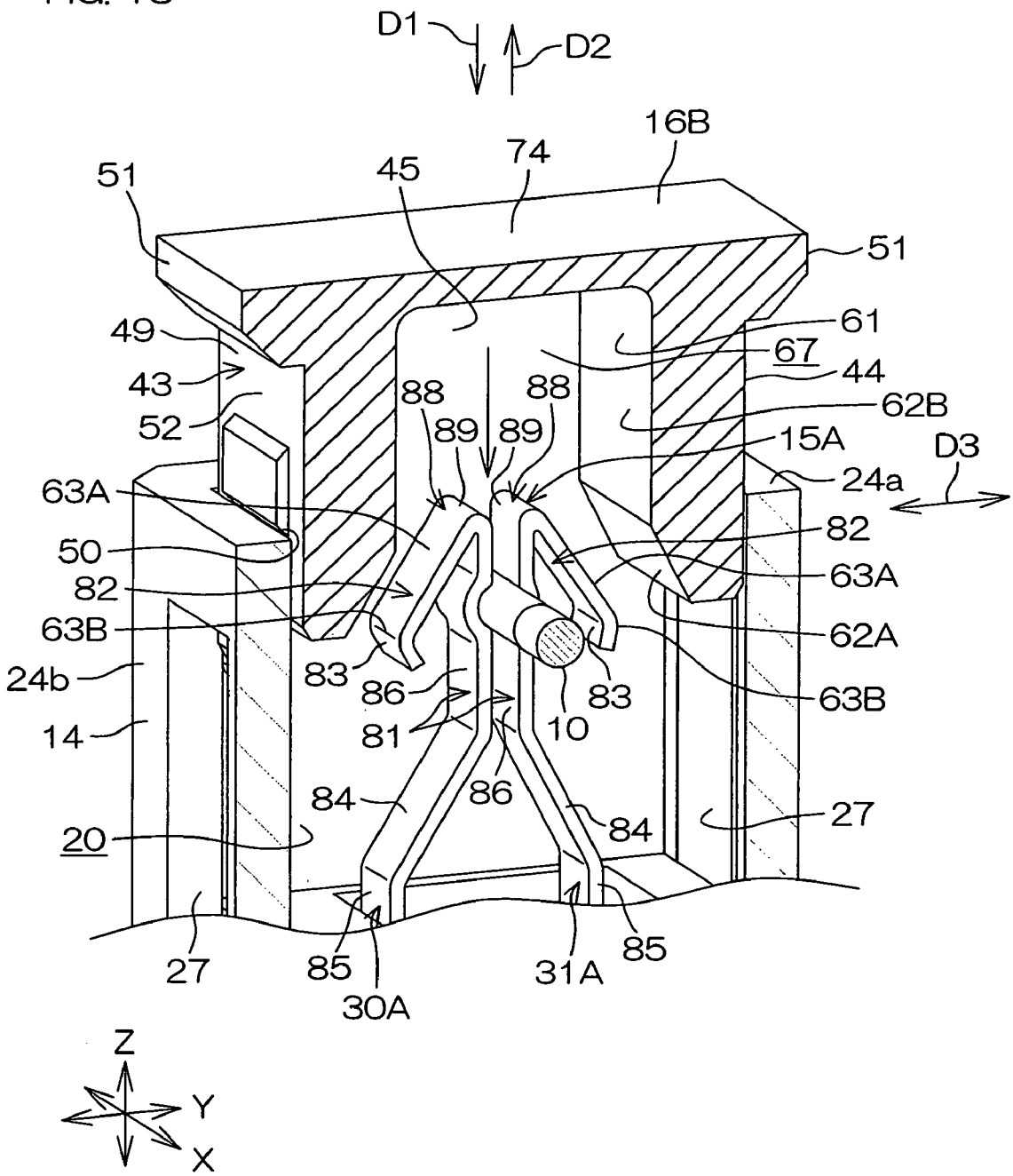
FIG. 13 is a partially sectional perspective view of an electrical connector according to another embodiment of the present invention.
Figure 14A:
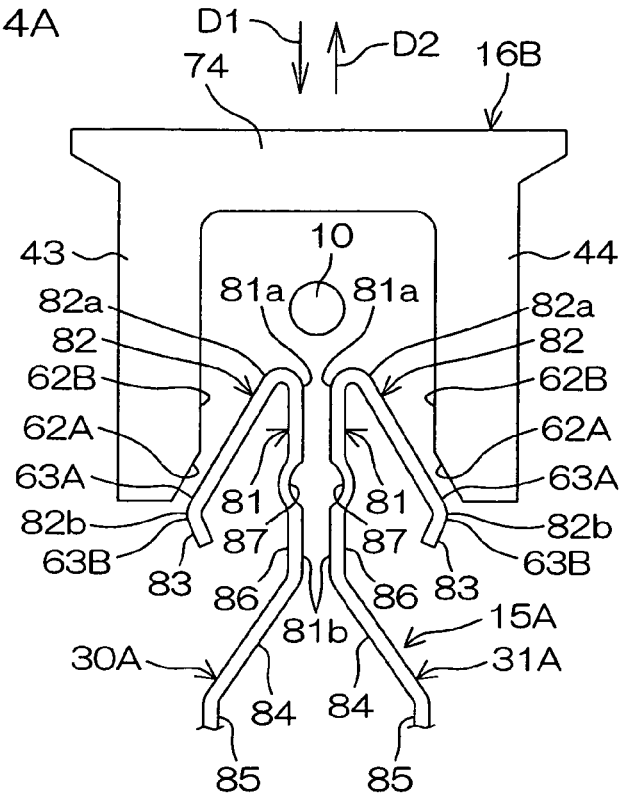
FIG. 14A and FIG. 14B are schematic diagrams which show sequential using processes of the electrical connector in FIG. 13.

FIG. 13, FIG. 14A, FIG. 14B, FIG. 15A and FIG. 15B show another embodiment of the present invention. Referring to FIG. 13 and FIG. 14A, this embodiment is different from that of FIG. 8 and FIG. 9 mainly in that a contact 15A is used instead of the contact 15 and an operating member 16B is used instead of the operating member 16.

The operating member 16B is the same as the operating member 16A in FIG. 12 in that the operating member 16B has the opening preventive portion 74. Further, the operating member 16B is different form the operating member 16A in FIG. 12 in that the widening operating portion 46 is omitted in the operating member 16B. Further, the operating member 16B is different form the operating member 16A in FIG. 12 in that the operating member 16B has a first pressurizing portion 62A and a second pressurizing portion 62B. The operating member 16B is retained by the housing 14 so as to be deformable in the first direction D1 or the second direction D2. The operating member 16B is deformed between a non-pressurizing position (see FIG. 3, FIG. 14A and FIG. 14B) in which a pair of elastic pieces 30A and 31A are released without being restrained, and a finally-pressurizing position (see FIG. 15B) in which pressurizing on the pair of elastic pieces 30A and 31A are completed.

The contact 15A comprises the pair of elastic pieces 30A and 31A. The pair of elastic pieces 30A and 31A respectively have a first piece 81, a second piece 82, a third piece 83, a fourth piece 84 and a fifth piece 85.

Each first piece 81 straightly extends generally in the second direction D2 as being the removing direction of the terminal 10. Each first piece 81 is supported by the respectively corresponding fourth piece 84 in an inclined shape, and each fourth piece 84 is supported by the fifth piece 85 extending in the second direction D2.

Each second piece 82 is extended from the respectively corresponding first piece 81 and supported by the respectively corresponding first piece 81 in a cantilever shape. Each third piece 83 is extended from the respectively corresponding second piece 82.

The first piece 81 of each of the elastic pieces 30A and 31A has a tip end portion 81*a* and a base end portion 81*b*.

The first piece 81 of each of the elastic pieces 30A and 31A has a straight portion 86, as a clamp portion, which extends with a predetermined length from the tip end portion 81*a* to the base end portion 81*b* thereof in the first direction D1 as being the removing direction of the terminal 10.

When the operating member 16B is disposed at the non-pressurizing position shown in FIG. 14A and the terminal 10 is not introduced between the elastic pieces 30A and 31A, a width between the straight portion 86 of the elastic piece 30A and the straight portion 86 of the elastic piece 31A is set slightly smaller than the diameter of the terminal 10. As a result, the terminal 10 which is introduced between the straight portions 86 of the pair of elastic pieces 30A and 31A can be moved smoothly in the first direction D1 while receiving a slight friction resistance.

Figure 14B:
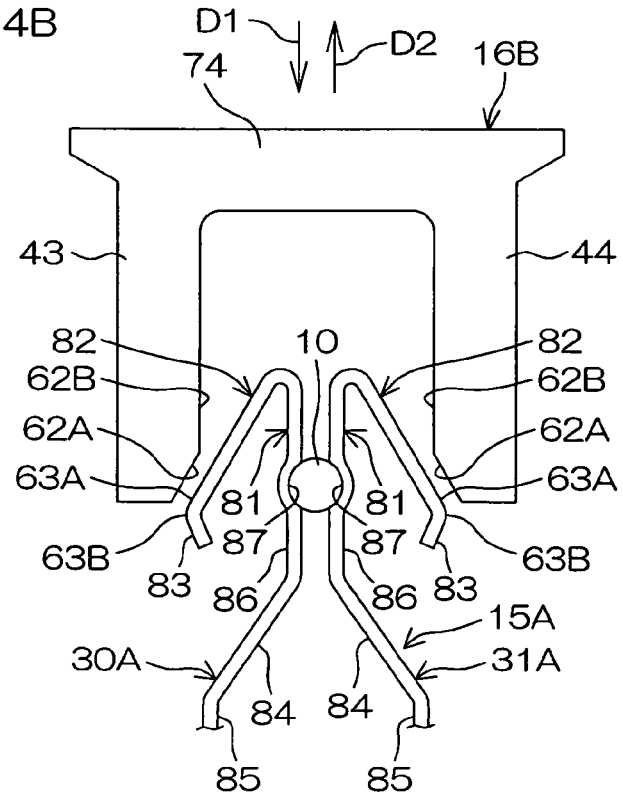

Further, with respect to the first direction D1, on a middle portion of each straight portion 86, a contact portion 87, as a clamp portion, is provided for positioning and retaining the terminal 10 in the first direction D1 as shown in FIG. 14B and also ensuring an electric contact with the retained terminal 10. The contact portion 87 of each straight portion 86 comprises an arced surface which substantially corresponds to a part of the outer circumferential surface of the retained terminal 10.

Referring to FIG. 13, the second piece 82 of each of the elastic pieces 30A and 31A is folded back outside in an inclined manner from the respectively corresponding first piece 81 via a curved portion 88. A part of the curved portion 88 forms a guide portion 89 which guides the introduction of the terminal 10 between the both straight portions 86.

Referring to FIG. 14A, a distance between the base end portions 82*a* of the second pieces 82 of the pair of elastic pieces 30A and 31A is narrower than a distance between the base end portions 82*b* of the second pieces 82 of the pair of elastic pieces 30A and 31A. At least a part of the outside surface of each second piece 82 forms a first pressurized portion 63A.

The third piece 83 of each of the elastic pieces 30A and 31A is folded so as to incline in a direction opposite to the respectively corresponding second piece 82. A tip portion, which is formed between the second piece 82 and the third piece 83 of each of the elastic pieces 30A and 31A, forms a second pressurized portion 63B.

Figure 15A:
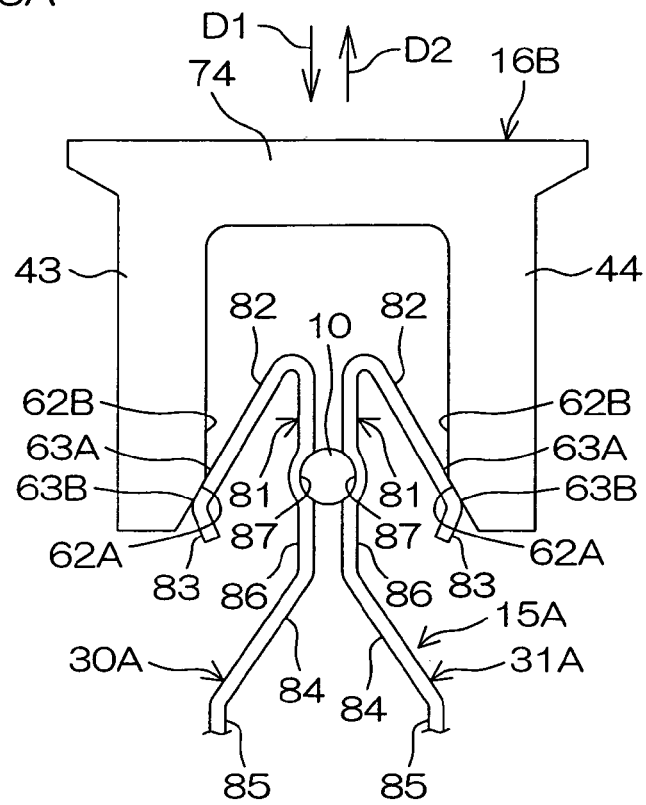
FIG. 15A and FIG. 15B are schematic diagrams which show sequential using processes of the electrical connector directly after the process in FIG. 14B.
Figure 15B:
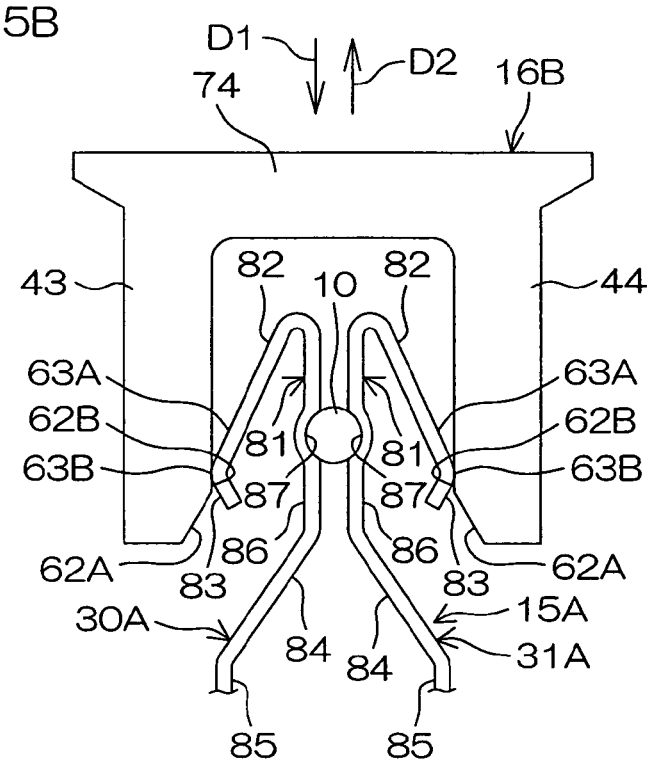

While the terminal 10 is kept clamped and retained between the contact portions 87 of the pair of elastic pieces 30A and 31A as shown in FIG. 14B, the operating member 16B is displaced to the finally-pressurizing position shown in FIG. 15B. During the process in which the operating member 16B is displaced to the finally-pressurizing position, each inclined first pressurizing portion 62A of the operating member 16B first pressurizes the first pressurized portion 88 of the respectively corresponding inclined second piece 82, as shown in FIG. 15A. As a result, each second piece 82 is elastically bent and deformed whereby to increase the clamping force on the terminal 10 between the both contact portions 87.

When the operating member 16B reaches the finally-pressurizing position shown in FIG. 15B, each second pressurizing portion 62 of the operating-member 16B pressurizes the second pressurized portion 63B of the corresponding elastic piece 30A or 31A. As a result, each second piece 82 is elastically bent and deformed with a sufficient deforming amount whereby to increase the clamping force on the terminal 10 between the both contact portions 87.

Furthermore, the restricting portion 73 can be omitted. The number of clamping members 11 to be provided for one cold cathode fluorescent tube 5 can be two or more. Furthermore, the connector 6 can be applied to an edge light type liquid crystal display device.

It is also possible that the connector of the present invention is used for connection to a shaft-like terminal of other than the fluorescent tube. For example, it can be used for connection to a terminal of a multipole cable including a number of twisted wires. In the case of the multipole cable, the diameter of the terminal becomes large, so that a sufficient contact pressure with the contact must be secured. Therefore, the effect of using the connector of the present invention which can secure a sufficient contact pressure and can be attached to the contact with no insertion force is significant.

The present invention is described in detail above based on a detailed embodiment, and those skilled in the art who understand the details of the description given above will readily conceive alterations, modifications, and equivalents thereof. Therefore, the scope of the present invention should be within the range of the claims and the equivalents thereof.

The present application corresponds to Japanese Patent Application No. 2005-248118 submitted to the Japanese Patent Office on Aug. 29, 2005, and the entire disclosure of this application is incorporated herein by reference.

The invention claimed is:

1. An electrical connector comprising:

an insulating housing;

a contact held by the housing; and an operating member for operating the contact, wherein the housing includes an insertion recess into which a shaft-like terminal is inserted in a first direction, the contact includes a pair of elastic pieces facing each other, at least a part of the pair of elastic pieces is exposed to the insertion recess, each of the elastic pieces is in a cantilevered shape having a base end portion and a tip end portion, the pair of elastic pieces are inclined with respect to the first direction so that a distance between the tip end portions becomes narrower than a distance between the base end portions, the pair of elastic pieces respectively include clamp portions for clamping the terminal in predetermined clamping directions orthogonal to the first direction, the first direction is in a radial direction of the terminal, and the operating member includes a widening operating portion for widening a distance between the clamp portions of the pair of elastic pieces.

2. The electrical connector according to claim 1, wherein the operating member can shift toward the first direction and a second direction opposite to the first direction, the operating member shifts to a widening position according to shifting toward the second direction, and shifts to a widening released position according to shifting toward the first direction, and by the widening operating portion of the operating member that has shifted to the widening position, the distance between the pair of clamp portions is widened to a distance which enables the terminal to be inserted between the pair of clamp portions with no insertion force.

3. The electrical connector according to claim 2, wherein the operating member is held by the housing in a manner enabling the operating member to shift between the widening position and the widening released position.

4. The electrical connector according to claim 2, wherein the operating member includes a pair of pressurizing portions, and the pair of pressurizing portions pressurize the pair of elastic pieces, respectively so as to narrow a distance between the pair of clamp portions when the operating member is at the widening released position.

5. The electrical connector according to claim 4, wherein the operating member includes a pair of portions disposed on both sides across the pair of elastic pieces in the insertion recess, and the pair of pressurizing portions are provided on the pair of portions, respectively.

6. The electrical connector according to claim 5, wherein the operating member forms an open portion for opening a space between the pair of portions to the second direction.

7. The electrical connector according to claim 5, wherein the operating member includes an opening preventive portion that prevents the space between the pair of portions from opening to the second direction.

8. The electrical connector according to claim 2, wherein the insertion recess includes a guide groove for guiding the operating member to the widening position and the widening released position in the first and second directions.

9. The electrical connector according to claim 2, wherein the widening operating portion of the operating member includes a receiving portion for receiving the terminal at a position corresponding to the clamp portions when the operating member is at the widening position.

10. The electrical connector according to claim 2, further comprising:

a holding mechanism for holding the operating member at the widening position.

11. The electrical connector according to claim 2, further comprising:

a holding mechanism for holding the operating member at the widening released position.

12. The electrical connector according to claim 1, wherein the terminal includes a terminal of a fluorescent tube.

13. The electrical connector according to claim 12, wherein the fluorescent tube includes a cold cathode fluorescent tube, and the terminal includes an outer lead exposed from an end portion of the cold cathode fluorescent tube.

14. The electrical connector according to claim 13, wherein the fluorescent tube includes an external electrode fluorescent tube, and the terminal includes an electrode layer coated on a peripheral surface of an end portion of the external electrode fluorescent tube.

15. A liquid crystal display device comprising:

a liquid crystal panel having a front face and a back face;

a circuit board having a first surface facing the back face of the liquid crystal panel and a second surface opposite to the first surface;

an electrical connector attached to the circuit board;

a fluorescent tube for a backlight which is disposed between the back face of the liquid crystal panel and the first surface of the circuit board, and has a terminal on an end portion; and an inverter circuit which is disposed on the second surface of the circuit board and supplies electrical power to the fluorescent tube, wherein the electrical connector comprises:

an insulating housing;

a contact held by the housing; and an operating member for operating the contact, a longitudinal direction of the fluorescent tube is parallel to the back face of the liquid crystal panel, the housing includes an insertion recess into which a shaft-like terminal is inserted in a first direction, the contact includes a pair of elastic pieces facing each other, at least a part of each of the elastic pieces is exposed to the insertion recess, each of the elastic piece is in a cantilevered shape having a base end portion and a tip end portion, the pair of elastic pieces are inclined with respect to the first direction so that a distance between the tip end portions becomes narrower than a distance between the base end portions, the pair of elastic pieces include clamp portions for clamping the terminal in a predetermined clamping direction orthogonal to the first direction, respectively, the first direction is in a radial direction of the terminal, the operating member includes a widening operating portion for widening the distance between the clamp portions of the pair of elastic pieces, the clamp portions of the pair of elastic pieces of the contact of the electrical connector clamp the terminal of the end portion of the fluorescent tube between the back face of the liquid crystal panel and the first surface of the circuit board, the contact includes a lead connected to the inverter circuit, and the lead extends in the second surface of the circuit board.

* * * * *